US010584491B2

(12) United States Patent
Oldroyd et al.

(10) Patent No.: US 10,584,491 B2
(45) Date of Patent: Mar. 10, 2020

(54) TRUSS STRUCTURE

(71) Applicant: ISOTRUSS INDUSTRIES LLC, Provo, UT (US)

(72) Inventors: Jordan W. Oldroyd, Provo, UT (US); Jonathan J. Curtis, Provo, UT (US); Carter J. Smith, Orem, UT (US); Nathan D. Rich, Orem, UT (US); David W. Jensen, Mapleton, UT (US)

(73) Assignee: ISOTRUSS INDUSTRIES LLC, Provo, UT (US)

( * ) Notice: Subject to any disclaimer, the term of this patent is extended or adjusted under 35 U.S.C. 154(b) by 0 days.

(21) Appl. No.: 16/122,459

(22) Filed: Sep. 5, 2018

(65) Prior Publication Data

US 2019/0003181 A1 Jan. 3, 2019

Related U.S. Application Data

(63) Continuation-in-part of application No. 15/913,832, filed on Mar. 6, 2018, now abandoned, which is a (Continued)

(51) Int. Cl.
*E04C 3/08* (2006.01)
*E04B 1/19* (2006.01)
(Continued)

(52) U.S. Cl.
CPC ..... *E04C 3/08* (2013.01); *E04B 1/19* (2013.01); *E04C 3/29* (2013.01); *E04H 12/10* (2013.01);
(Continued)

(58) Field of Classification Search
CPC ..... E04C 3/08; E04C 2003/0495; E04C 2003/0443; E04B 1/19; E04B 2001/1933
See application file for complete search history.

(56) References Cited

U.S. PATENT DOCUMENTS 1,465,307 A 8/1923 Keogan
1,613,788 A 1/1927 Dawson et al.
(Continued)

FOREIGN PATENT DOCUMENTS

FR 1377290 A 11/1964
GB 1251343 10/1971
(Continued)

OTHER PUBLICATIONS

Asay: "Bending Behavior of Carbon/Epoxy Composite IsoBeam Structures," Thesis, Mar. 8, 2016, 257 pages.
(Continued)

*Primary Examiner* — Joshua K Ihezie
(74) *Attorney, Agent, or Firm* — Brake Hughes Bellermann LLP

(57) ABSTRACT

A truss structure may include a plurality of load bearing members, or force members, that are joined at a plurality of nodes to define a load bearing structure. The truss structure may include a plurality of longitudinal members extending in parallel along a longitudinal length of the truss structure, and a plurality of transverse members defining a plurality of helical structures. The plurality of helical structures may be joined to the plurality of longitudinal members at corresponding plurality of nodes. The plurality of helical structures may provide buckling support to the plurality of longitudinal members, so that an axial load, or compressive load, or buckling load, may be effectively carried by the truss structure.

13 Claims, 29 Drawing Sheets

Related U.S. Application Data continuation-in-part of application No. 15/913,836, filed on Mar. 6, 2018.

(60) Provisional application No. 62/467,656, filed on Mar. 6, 2017.

(51) Int. Cl.
*E04H 12/10* (2006.01)
*E04C 3/29* (2006.01)
*E04C 3/04* (2006.01)

(52) U.S. Cl.
CPC ..... *E04B 2001/1933* (2013.01); *E04C 2003/0443* (2013.01); *E04C 2003/0491* (2013.01)

(56) References Cited

U.S. PATENT DOCUMENTS 1,798,064 A 3/1931 Chorlton et al.
1,922,269 A 8/1933 Wickwire, Jr.
2,106,674 A 1/1938 Busch
2,158,266 A 5/1939 Aldrich
2,362,688 A 11/1944 Dunn
2,879,687 A 3/1959 Leimbach et al.
2,931,467 A 4/1960 Fentiman
2,941,440 A 6/1960 Scanlon
3,007,497 A 11/1961 Shobert
3,062,336 A 11/1962 Baxter
3,495,687 A 2/1970 Shirley, Jr. et al.
3,496,687 A 2/1970 Greenberg et al.
3,501,880 A 3/1970 Bosch
3,705,473 A 12/1972 Yeffal-Rueda
3,798,864 A * 3/1974 Georgii ..... E04C 5/065 52/223.14
3,800,414 A 4/1974 Shattes et al.
3,970,116 A 7/1976 Takada et al.
3,992,118 A 11/1976 Siegers
4,077,828 A 3/1978 Strom
4,109,038 A 8/1978 Hayashi et al.
4,137,354 A 1/1979 Mayes, Jr. et al.
4,241,117 A 12/1980 Figge
4,253,284 A 3/1981 Bliss
4,260,143 A 4/1981 Kliger
4,321,854 A 3/1982 Foote et al.
4,337,560 A * 7/1982 Slysh ..... B64G 9/00 29/450
4,347,287 A 8/1982 Lewis et al.
4,366,658 A 1/1983 Maistre
4,380,483 A 4/1983 Kliger
4,471,548 A * 9/1984 Goudie ..... E04H 12/182 40/610
4,473,217 A 9/1984 Hashimoto
4,475,232 A 10/1984 Shaw
4,475,323 A 10/1984 Schwartzberg et al.
4,494,436 A 1/1985 Kruesi
4,539,786 A * 9/1985 Nelson ..... B64G 9/00 244/159.5
4,557,097 A 12/1985 Mikulas, Jr. et al.
4,655,022 A * 4/1987 Natori ..... B64G 9/00 52/108
4,686,134 A 8/1987 Ono
4,722,162 A * 2/1988 Wilensky ..... B64G 9/00 52/652.1
4,734,146 A 3/1988 Halcomb et al.
4,786,341 A 11/1988 Kobatake et al.
4,803,824 A 2/1989 Coppa
4,912,889 A * 4/1990 Palumbo ..... E04B 1/19 362/145
4,916,997 A 4/1990 Spain
4,951,440 A 8/1990 Staeger
4,986,863 A 1/1991 Denoel et al.
5,003,736 A 4/1991 Okazaki et al.
5,016,516 A 5/1991 Aldrich et al.
5,048,441 A 9/1991 Quigley
5,152,326 A 10/1992 Vohringer
5,184,444 A * 2/1993 Warden ..... B64G 9/00 52/108
5,197,254 A 3/1993 Smith
5,320,696 A 6/1994 McConnell et al.
5,356,234 A 10/1994 Vangool
5,388,538 A 2/1995 Chekroune et al.
5,463,970 A 11/1995 Hartlmeier et al.
5,505,035 A * 4/1996 Lalvani ..... A63B 9/00 52/311.2
5,556,677 A 9/1996 Quigley et al.
5,651,228 A 7/1997 Zeigler
5,846,364 A 12/1998 Policelli
5,921,048 A * 7/1999 Francom ..... E04O 3/08 242/437.3
5,962,150 A 10/1999 Priluck
5,985,304 A 11/1999 Van Voris et al.
6,076,324 A 6/2000 Daily et al.
6,264,684 B1 7/2001 Banas et al.
6,321,502 B1 11/2001 Castano
6,431,497 B1 8/2002 Hoyt et al.
6,439,096 B1 8/2002 Mungalov et al.
6,647,852 B1 * 11/2003 Freitas ..... B29C 70/222 87/1
6,910,308 B2 * 6/2005 Cadogan ..... E04H 15/20 52/646
7,132,027 B2 * 11/2006 Jensen ..... B29C 53/564 156/175
7,155,872 B2 * 1/2007 Francom ..... E04C 3/08 52/648.1
7,318,303 B1 1/2008 Kling
7,694,465 B2 * 4/2010 Pryor ..... E04C 3/005 138/119
7,694,486 B2 * 4/2010 Murphy ..... B64G 1/222 52/645
8,042,305 B2 * 10/2011 Pryor ..... B64G 1/222 244/159.4
8,320,727 B1 * 11/2012 Jacobsen ..... B29D 11/00663 385/129
8,444,900 B2 * 5/2013 Wilson ..... B29C 33/42 264/258
8,621,822 B2 * 1/2014 Brockwell ..... B29C 70/28 52/831
8,745,958 B2 * 6/2014 Kang ..... B21F 27/128 52/652.1
9,116,428 B1 * 8/2015 Jacobsen ..... G03F 7/09
2002/0081936 A1 * 6/2002 Snelson ..... A63H 33/10 446/111
2002/0124518 A1 * 9/2002 Warren ..... B64G 1/222 52/646
2004/0247866 A1 12/2004 Jensen
2005/0115186 A1 * 6/2005 Jensen ..... A45F 3/04 52/633
2007/0095012 A1 * 5/2007 Kang ..... B21F 27/12 52/750
2007/0151202 A1 * 7/2007 Cox ..... A61L 27/446 52/750
2010/0071300 A1 * 3/2010 Kang ..... B21F 3/02 52/646
2011/0117315 A1 * 5/2011 Kang ..... B21F 27/12 428/112
2012/0151868 A1 * 6/2012 Kang ..... B21F 27/128 52/649.1
2012/0225237 A1 * 9/2012 Brockwell ..... B29C 70/28 428/68
2013/0080123 A1 * 3/2013 Webbink ..... G06F 17/5009 703/1
2013/0167462 A1 * 7/2013 Wilson ..... B29C 33/42 52/309.16
2013/0243989 A1 * 9/2013 Ridges ..... B29O 53/566 428/36.91
2013/0276308 A1 * 10/2013 Kang ..... B21F 27/12 29/897
2013/0322955 A1 * 12/2013 Ma ..... E04B 1/1903 403/53

(56) References Cited

U.S. PATENT DOCUMENTS

| | | | | |
|---|---|---|---|---|
| 2014/0182232 | A1* | 7/2014 | Holt | B29C 70/56 52/645 |
| 2014/0288650 | A1* | 9/2014 | Hunt | A61F 2/447 623/16.11 |
| 2014/0302261 | A1* | 10/2014 | Cheung | B32B 3/06 428/33 |
| 2017/0100855 | A1* | 4/2017 | Taylor | B29B 15/127 |
| 2017/0173894 | A1* | 6/2017 | Konrad | B29C 45/14065 |
| 2017/0306923 | A1* | 10/2017 | Berthilsson | F03D 1/06 |

FOREIGN PATENT DOCUMENTS

| | | | |
|---|---|---|---|
| GB | 2049613 | A | 12/1980 |
| GB | 2164674 | A | 3/1986 |
| JP | 59-55946 | A | 3/1984 |
| JP | S6215695 | B2 | 4/1987 |
| WO | 98/45556 | A1 | 10/1998 |
| WO | 02/10535 | A2 | 2/2002 |

OTHER PUBLICATIONS

Hinds: "Shear-Dominated Bending Behavior of Carbon/Epoxy Composite Lattice IsoBeam Structures"; Thesis, Apr. 11, 2016, 161 pages.

37th AIAA/ASME/ASCE/AHS/ASC Structures, Structural Dynamics, and Materials Conference, Apr. 15-17, 1996, Salt Lake City, Utah, U.S.A., pp. 1868-1873.

Agard Conference Proceedings 531, Smart Structures for Aircraft and Spacecraft, Oct. 5-7, 1992, Lindau, Germany, 389 pages.

Wada et al.: First Joint U.S./Japan Conference on Adaptive Structures, Nov. 13-15, 1990, Maui, Hawaii, U.S.A., Technomic Publishing Co., Inc.

Matsuzaki et al.: Second Joint Japan/U.S. Conference on Adaptive Structures, Nov. 12-14, 1991, Nagoya, Japan, Technomic Publishing Co., Inc., 21 pages.

Allen, J. J. et al., "The Sandia Structural Control Experiments" Sandia National Laboratories, Albuquerque, New Mexico, pp. 928-951 presented at the First Joint US/ Japan Conference on Adaptive Structures Nov. 13-15, 1990.

Anderson, W.W. et al., The NASA-LaRC Controls-Structure Interaction Technology Program Guidance and Control Division, NASA, Hampton, Virginia, pp. 15-31, presented at the Second Joint US/ Japan Conference on Adaptive Structures Nov. 12-14, 1991.

Beer, F. et al. "Space Trusses"; Vector Mechanics for Engineers Statics Third Edition, pp. 222-228, 1977.

Betti, F. et al., "On Possible Applications of Smart Structures to Control of Space Systems" AGARD Conference proceedings 531 Smart Structures for Aircraft and Spacecraft held in Germany, Oct. 1992, pp. 26-1 to 26-14.

Breitbach, E. J., "Research Status on Adaptive Structures in Europe" Institute of Aeroelasticity, Goettingen, Germany, pp. 32-48, presented at the Second Joint US/ Japan Conference on Adaptive Structures Nov. 12-14, 1991.

Bronowicki, A.J. et al., "ACESA Structural Control System Design" TRW Space and Technology Group, Redondo Beach, California, pp. 373-401 presented at the First Joint US/ Japan Conference on Adapative Structures Nov. 13-15, 1990.

Chen, G.S. et at., "On an Adaptive Truss Manipulator Space Crane Concept" Jet Propulsion Laboratory, California Institute of Technology, Pasadena, California, pp. 726-742, presented at the First Joint US/ Japan Conference on Adaptive Structures Nov. 13-15, 1990.

Crawley, Edward et al., "Intelligent Structures a Technology Overview and Assessment": AGARD Conference proceedings 531 Smart Structures for Aircraft and Spacecraft held in Germany, Oct. 1992, Space Engineering Research Center, MIT, pp. 6-1 to 6-16, Cambridge, Massachusetts, USA.

Darooka et al, "Advanced Space Structure Concepts and Their Development", American Institute of Aeronautics and Astronautics, Structures, Structural Dynamics, and Materials Conference and Exhibit, 42nd Seattle Washington, Apr. 16-19, 2001, pp. 1-10.

Das, Alok et al., "Adaptive Structures for Spacecraft a USAF Perspective" AGARD Conference proceedings 531 Smart Structures for Aircraft and Spacecraft held in Germany, Oct. 1992 pp. 3-1 to 3-3-13.

Das, SK et al., "A Mathematical Basis for the Design and Design Optimization of Adaptive Trusses in Precision Control" Duke University, Durham North Carolina, pp. 660-690 presented at the First Joint US/ Japan Conference on Adaptive Structures Nov. 13-15, 1990.

D'Eleuterio, G. M. T., "Articulational Dynamics of Variable-Geometry Truss Structures" Institute for Aerospace Studies, University of Toronto, Downsview, Ontario, Canada, pp. 621-640, presented at the Second Joint US/ Japan Conference on Adaptive Structures Nov. 12-14, 1991.

Fanson, J.L. et al., "Damping and Structural Control of the JPL Phase 0 Testbed Structure" Jet Propulsion Laboratory Califomia Institute of Technology, Pasadena, California pp. 510-524 presented at the First Joint US/ Japan Conference on Adaptive Structures Nov. 13-15, 1990.

Fiber Innovations, Inc. "Braided Composite Structures", 6 pages.

Fiber Innovations, Inc. Brochure, 4 pages.

Fisher, S., "Real-Time Modifications of an Orbiting Spacecraft to Excite Vibrations Observed by a Ground-Based Laser Radar" Naval Research Laboratory, Washington, D.C., pp. 479-492, presented at the Second Joint US/ Japan Conference on Adaptive Structures Nov. 12-14, 1991.

Hibbeler, RC: "Space Trusses" Engineering Mechanics Statics, Chapter 6, Seventh Edition, pp. 267-270, Prentice-Hall, Englewood Cliffs, New Jersey, 1995.

Hughes, P.C., "Trussarm-A Variable-Geometry-Truss Manipulator" University of Toronto, Institute for Aerospace Studies, Toronto, Canada, pp. 715-725 presented at the First Joint US/ Japan Conference on Adaptive Structures Nov. 13-15, 1990.

Jensen, D. W. et al., "Dynamic Characterization of a Composite Lattice Structure with an Integrated Fiber-Optic Strain Sensor" The Pennsylvania State University, Department of Aerospace Engineering, University Park, Pennsylvania, pp. 828-845, presented at the First Joint US/ Japan Conference on Adaptive Structures Nov. 13-15, 1990.

Jensen, D. W. et al. "On the Structural Efficiency of Three-Dimensional Isogrid Designs"; 37<SUP>th </SUP>AIAA/ASME/ASCE/AHS/ASC Structures, Structural Dynamics, and Materials Conference; Apr. 15-17, 1996.

Jensen, W. D. et al., "Validation of Active Strain Measurements in Composites Using Mach-Zehnder Interferometry with Embedded Optical Fibers" The Pennsylvania State University, Department of Aerospace Engineering, University Park, Pennsylvania, pp. 771-788, presented at the Second Joint US/ Japan Conference on Adaptive Structures Nov. 12-14, 1991.

Kuo, C.P. et al., "Optimal Acutator Placement on an Active Reflector Using a Modified Simulated Annealing Technique" Applied Mechanics Technologies Section, Jet Propulsion Laboratory, California Institute of Technology, Pasadena, California, pp. 1056-1068 presented at the First Joint US/ Japan Conference on Adaptive Structures Nov. 13-15, 1990.

Kuwao, F. et al., "Quasi-Static Shape Estimation and Control of Adaptive Truss Structures Using Internal Displacement Structures" Applied mechanics Technologies Section, Jet Propulsion laboratory, California Institute of Technology, Pasadena, California, pp. 375-392, presented at the Second Joint US/ Japan Conference on Adaptive Structures Nov. 12-14, 1991.

Larson, L. B. et al., "An Experimental 10-Meter Space Truss with Tendon Control" School of Civil and Environmental Engineering, Cornell University Ithaca, New York, pp. 227-244, presented at the Second Joint US/ Japan Conference on Adaptive Structures Nov. 12-14, 1991.

Lawrence, C.R. et al., "Active Member Vibration Control Experiment in a KC-135 Reduced Gravity Environment" Jet Propulsion Laboratory, California Institute of Technology, Pasadena, California, pp. 987-1003 presented at the First Joint US/ Japan Conference on Adaptive Structures Nov. 13-15, 1990.

(56) References Cited

OTHER PUBLICATIONS

Maclean, B.J. et al., "Development of a Shape Memory Material Actuator for Adaptive Truss Applications" Materials and Structures Group Research & Technology, Martin Marietta Space Systems Denver, Colorado, pp. 1038-1055 presented at the First Joint US/ Japan Conference on Adaptive Structures Nov. 13-15, 1990.
Matsuzaki, Y. et al., "Application of Fuzzy Control to Computer Simulation of Tracking and Rendezvous Test for Docking of an Adaptive Space Structure" Department of Aerospace Engineering, Nagoya University, Chikusa, Nagoya, Japan, pp. 641-652, presented at the Second Joint US/ Japan Conference on Adaptive Structures Nov. 12-14, 1991.
Matsuzaki, Y. et al., "Application of Fuzzy Control to Tracking for Docking Operation of an Adaptive Space Structure" Department of Aerospace Engineering, Nagoya university, Chikusa, Nagoya Japan, pp. 792-806 presented at the First Joint US/ Japan Conference on Adaptive Structures Nov. 13-15, 1990.
Miura, K. et al., "Aerospace Research Status on Adaptive Structures in Japan" Institute of Space and Astronautical Sciences, Yoshinodai, Sagamihara, Japan, pp. 3-14, presented at the Second Joint US/ Japan Conference on Adaptive Structures Nov. 12-14, 1991.
Mobrem, M. et al., "Control Design of Space Station Mobile Transporter with Multiple Constraints" Astro Aerospace Corporation, Carpentaria, California pp. 87-116 presented at the First Joint US/Japan Conference on Adaptive Structures Nov. 13-15, 1990.
Modi, V.J. et al., "Formulation for a Class of Adaptive Structures with Applications" Department of Mechanical Engineering, The University of British Columbia, Vancouver, British Columbia, Canada, pp. 92-110, presented at the Second Joint US/ Japan Conference on Adaptive Structures Nov. 12-14, 1991.
Murotsu, Y. et al., "Optical Configuration Control of an Intelligent Truss Structure" Department of Aeronautical Engineering, College of Engineering, University o f Osaka Prefecture, Sakai, Osaka Japan, pp. 157-175 presented at the First Joint US/ Japan Conference on Adaptive Structures Nov. 13-15, 1990.
Murotsu, Y. et al., "Some Approaches to the Optimal Adaptive Geometries of Intelligent Truss Structures" University of Osaka Prefectures, Sakai, Osaka, Japan, pp. 743-771, presented at the First Joint US/ Japan Conference on Adaptive Structures Nov. 13-15, 1990.
Murotsu, Y. et al., "PD-Impedance Control of Docking Mechanism Composed of Intelligent Adaptive Structure" Department of Aeronautical Engineering, College of Engineering, University of Osaka Prefecture, Sakai, Osaka, Japan, pp. 653-669, presented at the Second Joint US/ Japan Conference on Adaptive Structures Nov. 12-14, 1991.
Naccarato, F. et al., "Redundancy Resolution in Variable-Geometry Truss Manipulators Using Reference Shape Curves" Institute for Aerospace Studies, University of Toronto, Downsview, Ontario, Canada, pp. 539-555, presented at the Second Joint US/ Japan Conference on Adaptive Structures Nov. 12-14, 1991.
Natori, M.C. et al., "Application of Adaptive Structure Concepts to Construction of space Systems in Orbit-Concepts and Formulation" Institute of Space and Astronautical Science Sagamihara, Japan pp. 77-91, presented at the Second Joint US/ Japan Conference on Adaptive Structures Nov. 12-14, 1991.
Pai, S.S. et al., "Probabilistic Structural Analysis of Adaptive/Smart/ Intelligent Space Structures" National Aeronautics and Space Administration, Lewis Research Center, Cleveland, Ohio, pp. 419-433, presented at the Second Joint US/ Japan Conference on Adaptive Structures Nov. 12-14, 1991.
Seguchi, Y., "Criteria-Oriented Configuration Control of Adaptive Structure and its Modular Neural Network Representation" Department of Mechanical Engineering, Osaka University Toyonaka, Osaka Japan, pp. 402-421 presented at the First Joint US/ Japan Conference on Adaptive Structures Nov. 13-15, 1990.
Shibuta, S. et al., "Adaptive Control of Space Truss Structures by Piezoelectric Actuator" National Space Development Agency of Japan Tsukuba Space Center, Ibaraki, Japan, pp. 245-262, presented at the Second Joint US/ Japan Conference on Adaptive Structures Nov. 12-14, 1991.
Sirlin, S. W. et al., "Active Structural Control for Damping Augmentation and Compensation of Thermal Distortion" Jet Propulsion Laboratory, California Insititute of Technology, Pasadena, California, pp. 434-444, presented at the Second Joint US/ Japan Conference on Adaptive Structures Nov. 12-14, 1991.
Sirlin, S.W. et al., "Sizing of Active Piezoelectric Struts for Vibration Suppression on a Space-Based Interferometer" Jet Propulsion Laboratory California Institute of Technology, Pasadena, California pp. 47-63, 1991.
Stover, D., "Braiding and RTM Succeed in Aircraft Primary Structures", Advanced Composites May/Jun. 1989, 4 pages.
Swanson, A. D. et al., "Zero-Gravity Dynamics of Space Structures in Parabolic Aircraft Flight" flight dynamics laboratory, air force Wright research and development center ,Wright-Patterson Air Force Base, Ohio, pp. 952-965 pesented at the First Joint US/ Japan Conference on Adaptive Structures Nov. 13-15, 1990.
Tabata, M. et al., "Shape Adjustment of a Flexible space Antenna Reflector": Mitsubishi Electric Corporation, Center Research Laboratory, Hyogo, Japan, pp. 393-405, presented at the Second Joint US/ Japan Conference on Adaptive Structures Nov. 12-14, 1991.
Tanaka, M. et al., "On Damping Enhancement of LSS Coupled with the Antenna Pointing System" Toshiba Corporation, Kawasaki, Japan, pp. 510-524 presented at the First Joint US/ Japan Conference on Adaptive Structures Nov. 13-15, 1990.
Tanaka, M. et al., "Stochastic Approach to Static Control of Adaptive Truss under Imperfection of Adjustable Member Lengths" Department of Mechanical Engineering, Osaka University, Osaka, Japan, pp. 406-418, presented at the Second Joint US/ Japan Conference on Adaptive Structures Nov. 12-14, 1991.
Tanaka, M. et al., Kinematics of Adapative Truss Permitting Modal Offset (configuration and workspace reach), Osaka university, Department of Mechanical engineering, Osaka, Japan, pp. 691-714, presented at the First Joint US/ Japan Conference on Adaptive Structures Nov. 13-15, 1990.
Tidwell, Ph et al., "Kinematic Analysis of Generalized Adaptive Trusses" Mechanical Engineering Department, Virginia Polytechnic Institute and State University, Blacksburg, Virginia, pp. 772-791 presented at the First Joint US/ Japan Conference on Adaptive Structures Nov. 13-15, 1990.
Troidl H. et al., "Dynamic Tests on the NASA Langley CSI Evolutionary Model" AGARD Conference proceedings 531 Smart Structures for Aircraft and Spacecraft held in Germany, Oct. 1992, pp. 4-1 to 4-9.
Wada, B. K. et al., "Application of Adaptive Structures for the Control of Truss Structures" Jet Propulsion Laboratory, Califomia Institute of Technology Pasadena, California, pp. 123-131, presented at the Second Joint US/ Japan Conference on Adaptive Structures Nov. 12-14, 1991.
Wada, Ben K. et al., "Advances in Adaptive Structures at Jet Propulsion Laboratory" AGARD Conference proceedings 531 Smart Structures for Aircraft and Spacecraft held in Germany, Oct. 1992, Applied Mechanics Technologies Section, pp. 28-1 to 28-13, Pasadena, California, USA.
Yokoi, K et al., "A Method for Solving Inverse Kinematics of Variable Structure Truss Arm with High Redundancy" Robotics Department, Mechanical Engineering Laboratory, Tsukuba, Ibaraki, Japan, pp. 606-620, presented at the Second Joint US/ Japan Conference on Adaptive Structures Nov. 12-14, 1991.
Yoshida, K et al., "COSMO-LAB Concept: A Cooperation of Space Robots and Structures" Department of Mechanical Engineering Science, Tokyo Institute of Technology, Tokyo, Japan, pp. 59-76, presented at the Second Joint US/ Japan Conference on Adaptive Structures Nov. 12-14, 1991.
U.S. Pat. No. 31,777, "Iron Masts, Steeps, &c," issued to E.S. Boynton, patented on Mar. 26, 1861, 5 pages.

* cited by examiner (b)

(a)

(b)

(a)

(a) (b)

(b)

(a)

TRUSS STRUCTURE

CROSS REFERENCE TO RELATED APPLICATIONS

This application is a Continuation-in-Part of U.S. application Ser. No. 15/913,832 filed on Mar. 6, 2018, and of U.S. application Ser. No. 15/913,836 filed on Mar. 6, 2018, both of which claim priority to U.S. Provisional Application No. 62/467,656, filed on Mar. 6, 2017, the disclosures of which are incorporated by reference herein in their entirety.

FIELD

This document relates, generally, to truss structures.

BACKGROUND

A truss structure may include a plurality of load bearing members, or force members, that are joined at a plurality of nodes to define a load bearing structure. A truss structure may be employed in situations in which a support structure is to bear a considerable load across a relatively extensive span, and in a situation in which weight of the support structure itself may affect the performance of the support structure.

SUMMARY

In one aspect, a three-dimensional (3D) load bearing structure may include a plurality of helical structures concentrically arranged about a central longitudinal axis. In some implementations, each of the plurality of helical structures may include a plurality of strands of filament material, and a binding material on an outer peripheral portion of the strands of filament material, holding the plurality of strands of filament material together. The 3D load bearing structure may also include a plurality of longitudinal members each aligned in parallel with the central longitudinal axis, and a coupling mechanism, coupling the plurality of helical structures to the plurality of longitudinal members at a respective plurality of nodes, wherein each node of the plurality of nodes is defined at a point at which a longitudinal member, of the plurality of longitudinal members, and at least one helical structure, of the plurality of helical structures, overlap.

In another aspect, a method may include sequentially arranging a plurality of helical structures concentrically about a central longitudinal axis, arranging a plurality of longitudinal members about the central longitudinal axis such that each of the plurality of longitudinal members is aligned in parallel with the central longitudinal axis, and coupling the plurality of helical structures to the plurality longitudinal members at a respective plurality of nodes, each node of the plurality of nodes being defined at a point at which a longitudinal member, of the plurality of longitudinal members, and at least one helical structure, of the plurality of helical structures, cross.

The details of one or more implementations are set forth in the accompanying drawings and the description below. Other features will be apparent from the description and drawings, and from the claims.

DETAILED DESCRIPTION

A truss structure may be a three dimensional load bearing structure including a plurality of load bearing members. The plurality of load bearing members may be joined at a plurality of nodes, and may be arranged so that the assembled plurality of load bearing members act together, as a single load bearing structure. In some implementations, the load bearing members may be arranged, and joined at the plurality of nodes, so that the load bearing members and the nodes are positioned in multiple different planes, defining a three dimensional truss structure. In some implementations, the truss structure may include a plurality of longitudinal members and a plurality of transverse members. In some implementations, the plurality of transverse members may be arranged end to end, to define one or more helical structures. In some implementations, the plurality of longitudinal members may provide for bending and axial strength of the truss structure. In some implementations, the plurality of transverse members may carry shear and torsional forces applied to the truss structure.

A truss structure, in accordance with implementations described herein, may include a plurality of longitudinal members extending along a longitudinal length of the truss structure. A plurality of transverse members may extend between the longitudinal members. The plurality of transverse members may define one or more tetrahedral shapes arranged end to end in a helical structure. Portions of the resulting helical structures may be respectively joined to the longitudinal members at a plurality of nodes, to form a lattice type truss structure. In some implementations, the plurality of longitudinal members may include an arrangement of filament material, or fibers, such as, for example, carbon fiber filament material, fiberglass filament material, and the like. In some implementations, the fibers and/or filaments of the longitudinal members may be arranged in tows, and may be impregnated with a material such as, for example, an epoxy, a resin, and the like. In some implementations, the plurality of transverse members (forming the helical structures) may include an arrangement of filament material, or fibers, for example, carbon fiber filament material, fiberglass filament material, and the like. In some implementations, the fibers and/or filaments of the transverse members may be impregnated with a material such as, for example, an epoxy, a resin, and the like.

In some implementations, the fibers of the longitudinal members and the fibers of the transverse members may be interwoven at the nodes, to join the plurality of longitudinal members and the plurality of transverse members. In some implementations, a coupling mechanism may couple the plurality of longitudinal members and the plurality of transverse members at the nodes, to join the helical structures and the plurality of longitudinal members and form a truss structure, in accordance with implementations described herein.

Figure 1A:
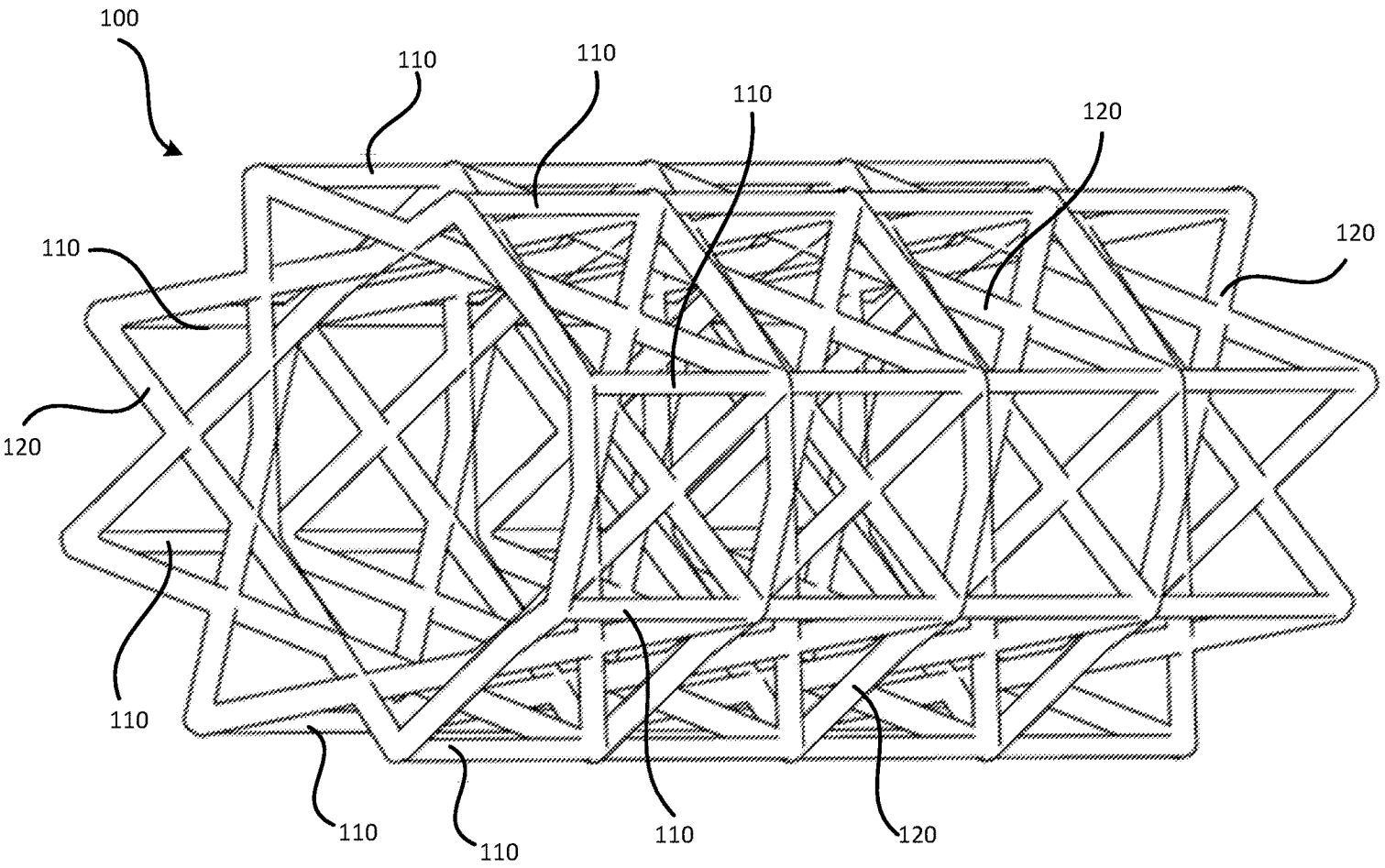
FIG. 1A is a perspective view.
Figure 1B:
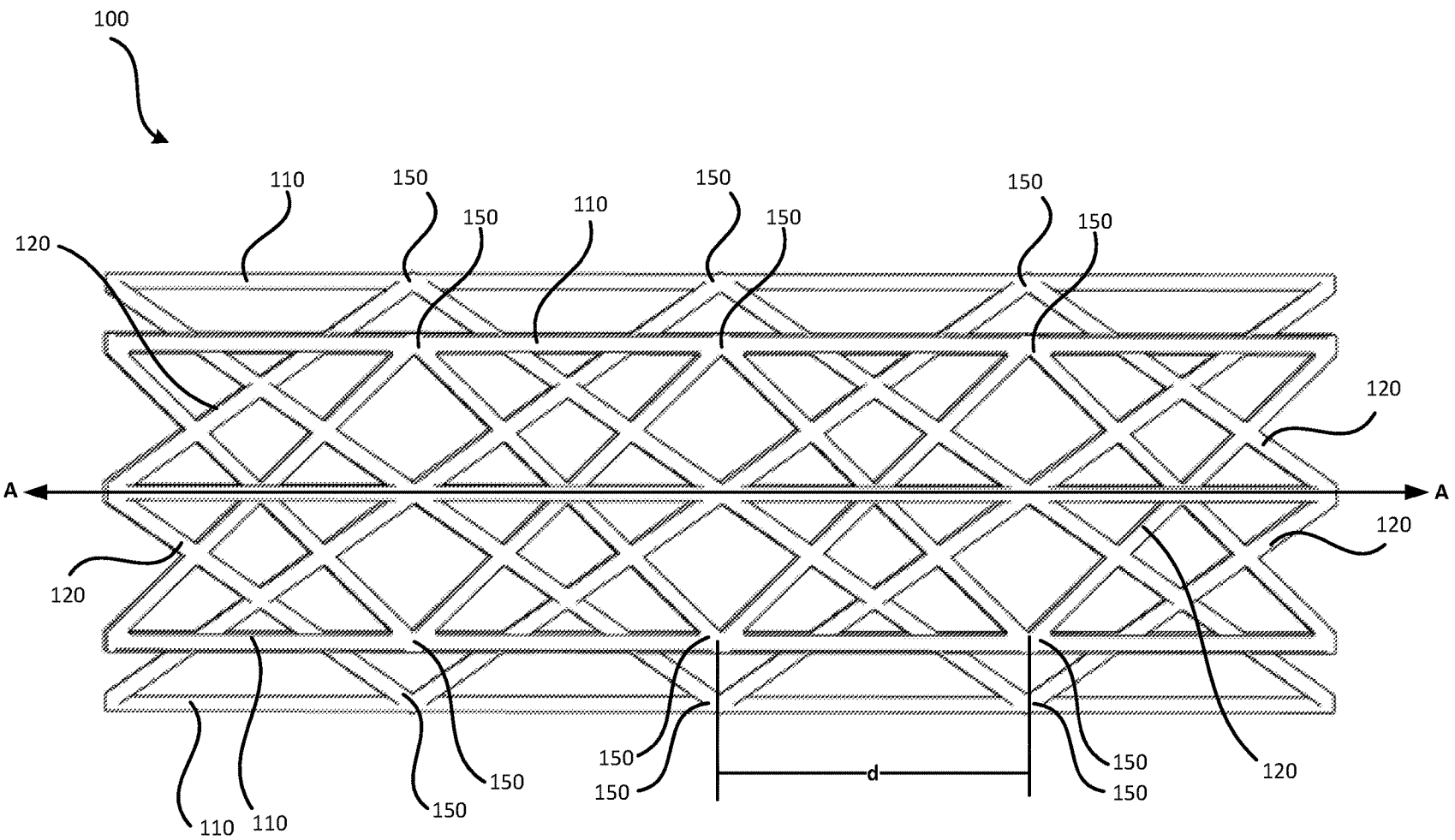
FIG. 1B is a side view.
Figure 1C:
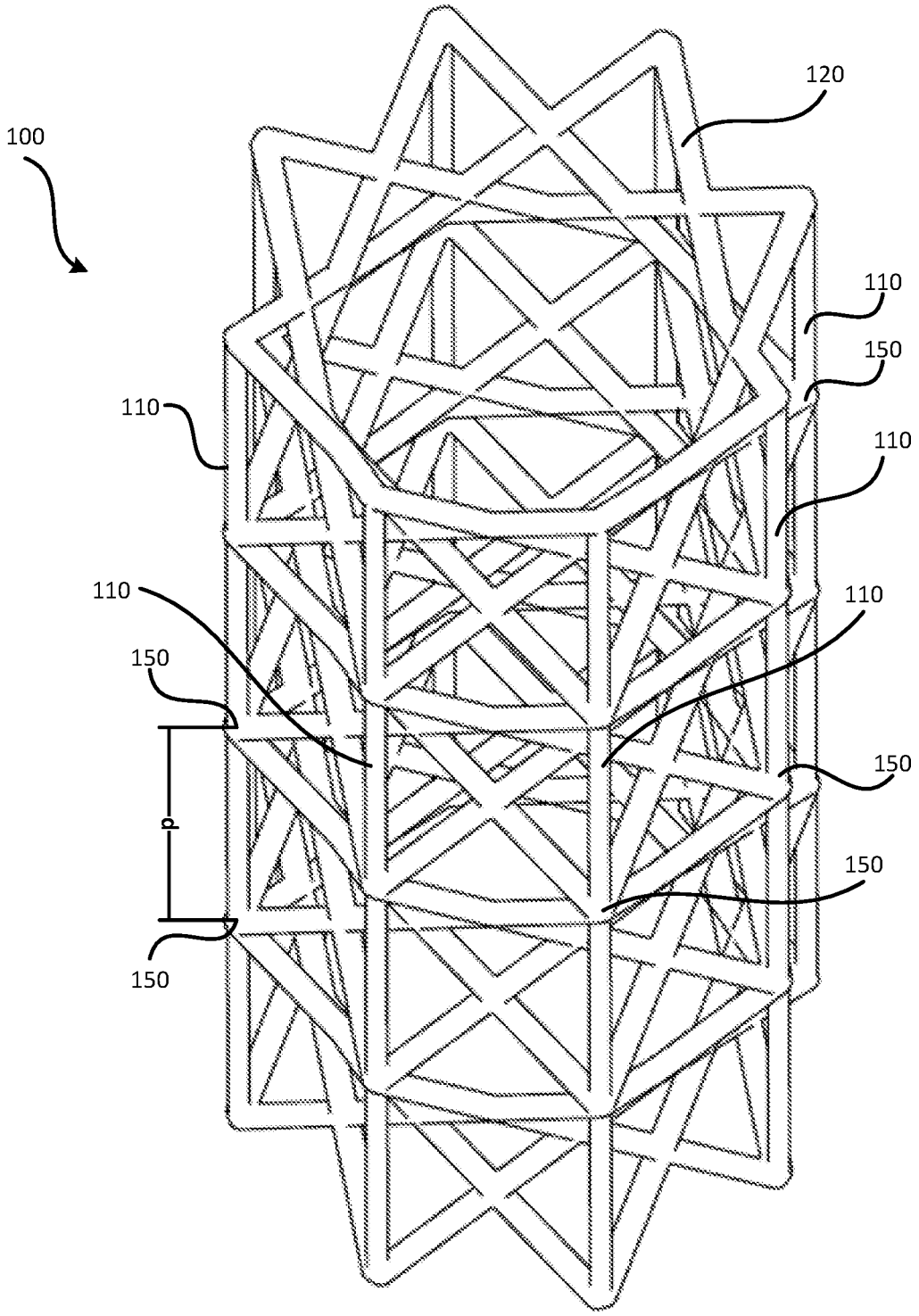
FIG. 1C is an isometric view.
Figure 1D:
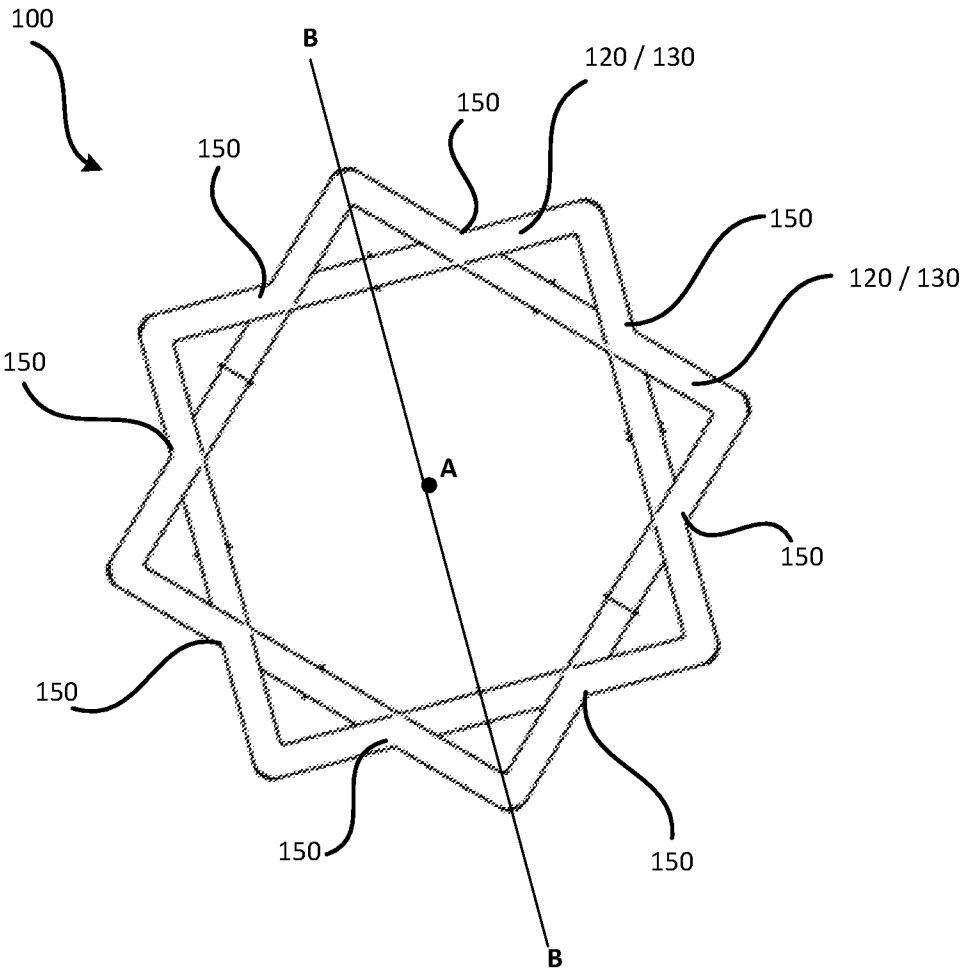
FIG. 1D is an axial end view, of an example truss structure, in accordance with implementations described herein.

An exemplary truss structure 100, in accordance with implementations described herein, is shown in FIGS. 1A-1D. In particular, FIG. 1A is a perspective view of the exemplary truss structure 100, FIG. 1B is a side view of the exemplary truss structure 100, FIG. 1C is a view of an exemplary node of the exemplary truss structure 100, and FIG. 1D is an axial end view of the exemplary truss structure 100. The exemplary truss structure 100 shown in FIGS. 1A-1D is illustrated in a substantially horizontal orientation, with a central longitudinal axis A of the exemplary truss structure 100 extending substantially horizontally, simply for purposes of discussion and illustration. However, the principles to be described herein with respect to the exemplary truss structure 100 may also be applied to a plurality of other orientations of the truss structure 100.

The exemplary truss structure 100 may include a plurality of longitudinal members 110 extending axially, along a length L of the truss structure 100. The plurality of longitudinal members 110 may define a longitudinal frame portion of the truss structure 100. The longitudinal frame defined by the plurality of longitudinal members 110 may carry an axial load portion of a force exerted on, or a load borne by, the truss structure 100. The exemplary truss structure 100 shown in FIGS. 1A-1D includes eight longitudinal members 110. However, in some implementations, the truss structure 100 may include more, or fewer, longitudinal members 110. Numerous factors may affect the number of longitudinal members 110 included in the truss structure 100. These factors may include, for example, an overall longitudinal length of the truss structure 100, a load to be carried by the truss structure 100 (including, for example, an amount of torsional loading, an amount of bending loading, an amount of tension/compression loading, and other such loads which may be applied to the truss structure 100), environmental factors associated with the installation of the truss structure 100, and other such factors.

In some implementations, each of the plurality of longitudinal members 110 defining the longitudinal frame portion of the truss structure 100 may be arranged in parallel to each other, and in parallel with the central longitudinal axis A of the truss structure 100. In some implementations, the arrangement of the longitudinal members 110 may be symmetric about any one of a plurality of different central planes extending through the central longitudinal axis A of the truss structure 100. The exemplary central plane B extending through the central longitudinal axis A of the truss structure 100 shown in FIG. 1D is just one example of a central plane extending through the central longitudinal axis A of the truss structure 100. The longitudinal members 110 of the truss structure 100 may be symmetrically arranged about any number of different central planes extending through the central longitudinal axis A of the truss structure 100.

The exemplary truss structure 100 may include a plurality of transverse members 120. The plurality of transverse members 120 may define a transverse frame portion of the truss structure 100. In some implementations, the transverse frame portion of the truss structure 100 defined by the plurality of transverse members 120 may carry a torsional load portion of a force exerted on, or a load borne by, the truss structure 100. In some implementations, the transverse frame may be coupled to, or joined with, or intersect, or be integrally formed with, the longitudinal frame to form the truss structure 100. That is, the transverse members 120 may in some manner be coupled to, or joined with, or intersect, or be integrally formed with, the longitudinal members 110 at a respective plurality of nodes 150. The longitudinal members 110 of the truss structure 100 may carry an axial, or compressive, or bending load applied to the truss structure 100. The transverses members 120 may provide reinforcement to the longitudinal members 110, to provide buckling resistance to the longitudinal members 110. In some situations and/or arrangements, the transverse members 120 may carry a torsional component of the load applied to the truss structure 100.

In some implementations, the transverse members 120 may be disposed in a somewhat helical arrangement with respect to the longitudinal members 110 defining the longitudinal frame. Simply for ease of discussion and illustration, FIGS. 2A-2H illustrate a sequential addition of exemplary three dimensional polyhedral structures 130A through 130H (each formed by a series of transverse members 120 arranged end to end) relative to, for example, a longitudinally oriented fixture, for example, a manufacturing frame or jig, on which the polyhedral structures 130A-130H and longitudinal members 110 may be assembled, simply for purposes of illustration. In the example illustrated in FIGS. 2A-2H, such a longitudinally oriented fixture is not illustrated, simply to more clearly illustrate the relative arrangement of the helical structures 130A through 130H relative to an exemplary longitudinal frame including a plurality of longitudinal members 110 included in the truss structure 100.

The three dimensional polyhedral structures 130 may be referred to as helical structures 130, simply for ease of discussion, in that the three dimensional polyhedral structures 130 appear to follow a somewhat helical pattern within the truss structure 100. The helical structures 130A-130H may be incrementally, and sequentially, positioned along the longitudinal length of the truss structure 100. Each of FIGS. 2A through 2H includes an axial view (a) of the truss structure 100, and a longitudinal perspective view (b) of the truss structure 100 as a series of helical structures 130 are sequentially added. In the example shown in FIGS. 2A-2H, the helical three dimensional polyhedral structures 130 define a series of somewhat rectangular, or square, polyhedral shapes each including four corners, or vertices, simply for ease of discussion and illustration. This exemplary series of polyhedral structures 130 would be combined with eight longitudinal members 110 to form the truss structure 100. However, as noted above, the truss structure 100 may include more, or fewer, longitudinal members 110, with a configuration of the helical structures 130 formed by the arrangement of transverse members 120 being defined according to the number of longitudinal members 110. As also noted above, in some implementations, regardless of the number of longitudinal members 110, the longitudinal members may be arranged in parallel to each other, about a central longitudinal axis A, and may be arranged symmetrically about a central longitudinal plane B. In the example arrangement shown in FIGS. 2A-2H, the helical structures 130A through 130G are in a counter-clockwise arrangement, or orientation. However, in some implementations, the helical structures 130 may be in a clockwise arrangement, or orientation.

As noted above, FIGS. 2A-2H provide a sequential illustration of the arrangement of exemplary helical structures 130 of the truss structure 100. The exemplary sequential illustration in FIGS. 2A-2H is provided to facilitate an understanding of the physical arrangement of the transverse members 120 (making up the helical structures 130), and is not intended to be representative of a specific process or sequencing by which the truss structure 100, in accordance with implementations described herein, is actually manufactured.

Figure 2A:
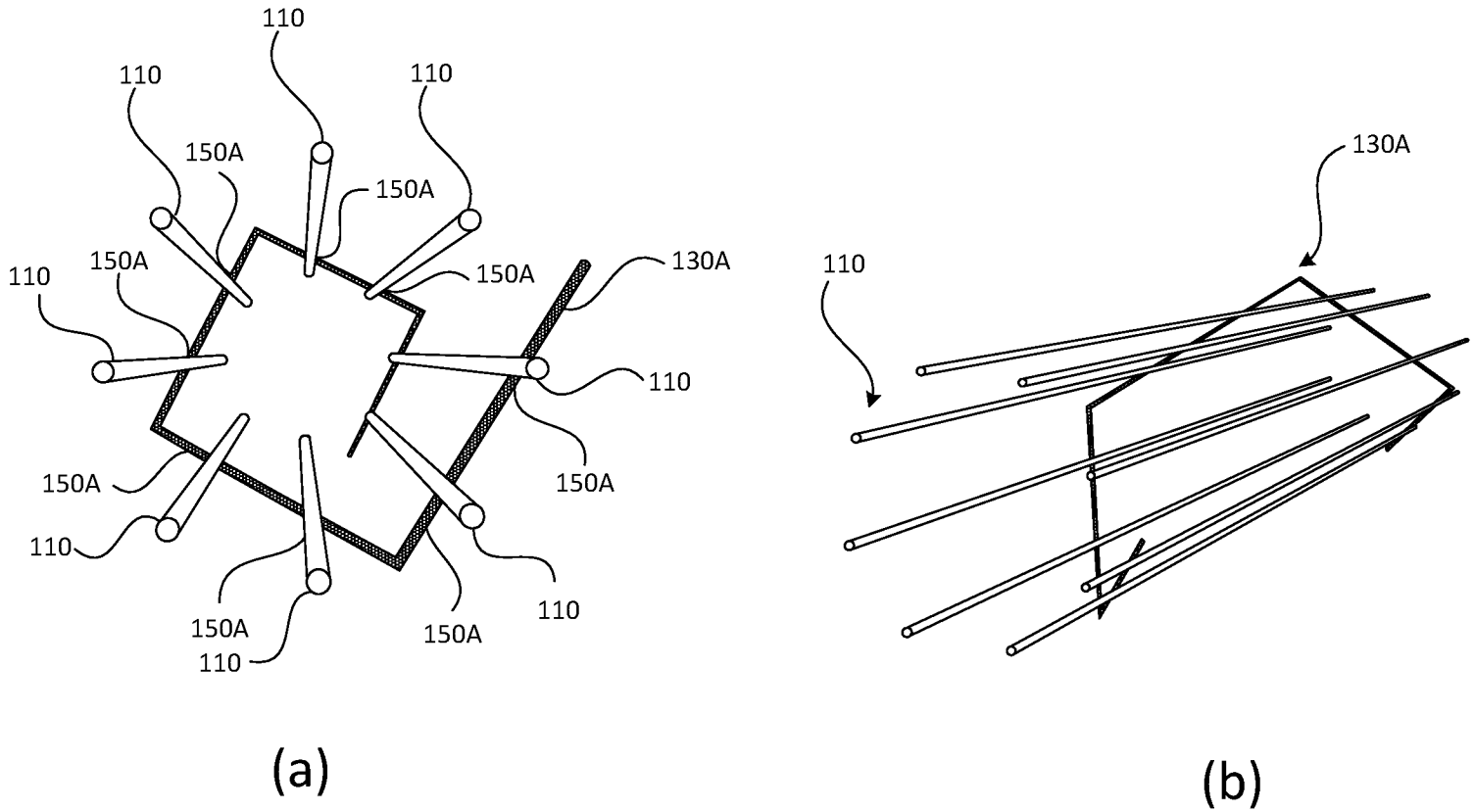
FIGS. 2A-2H illustrate an exemplary sequential application of three dimensional polyhedral structures to a longitudinal frame formed by a plurality of longitudinal members to form an example truss structure, in accordance with implementations described herein.
Figure 2B:
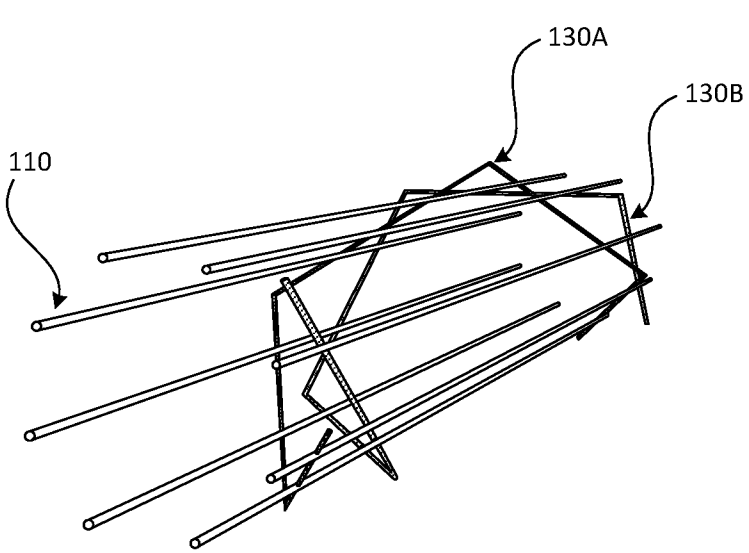
Figure 2B:
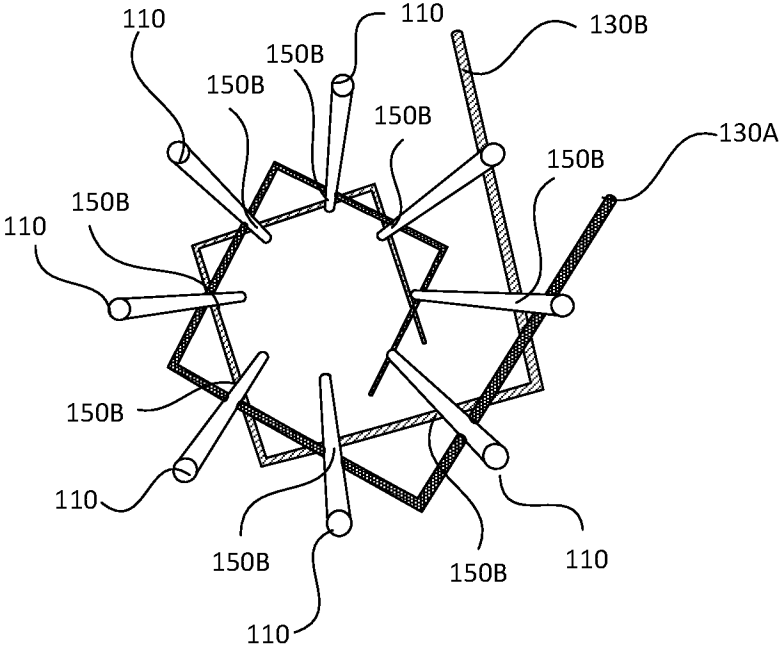
Figure 2C:
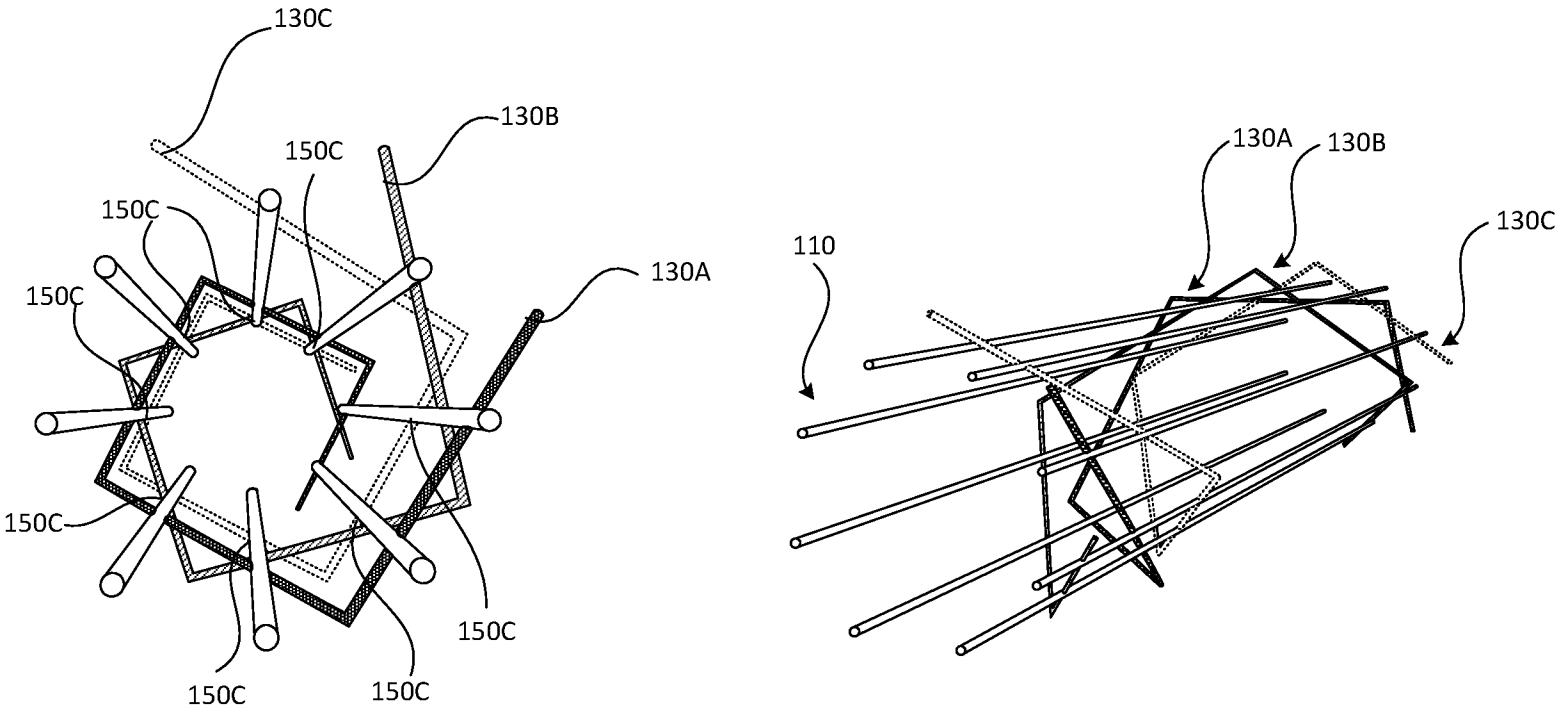
Figure 2D:
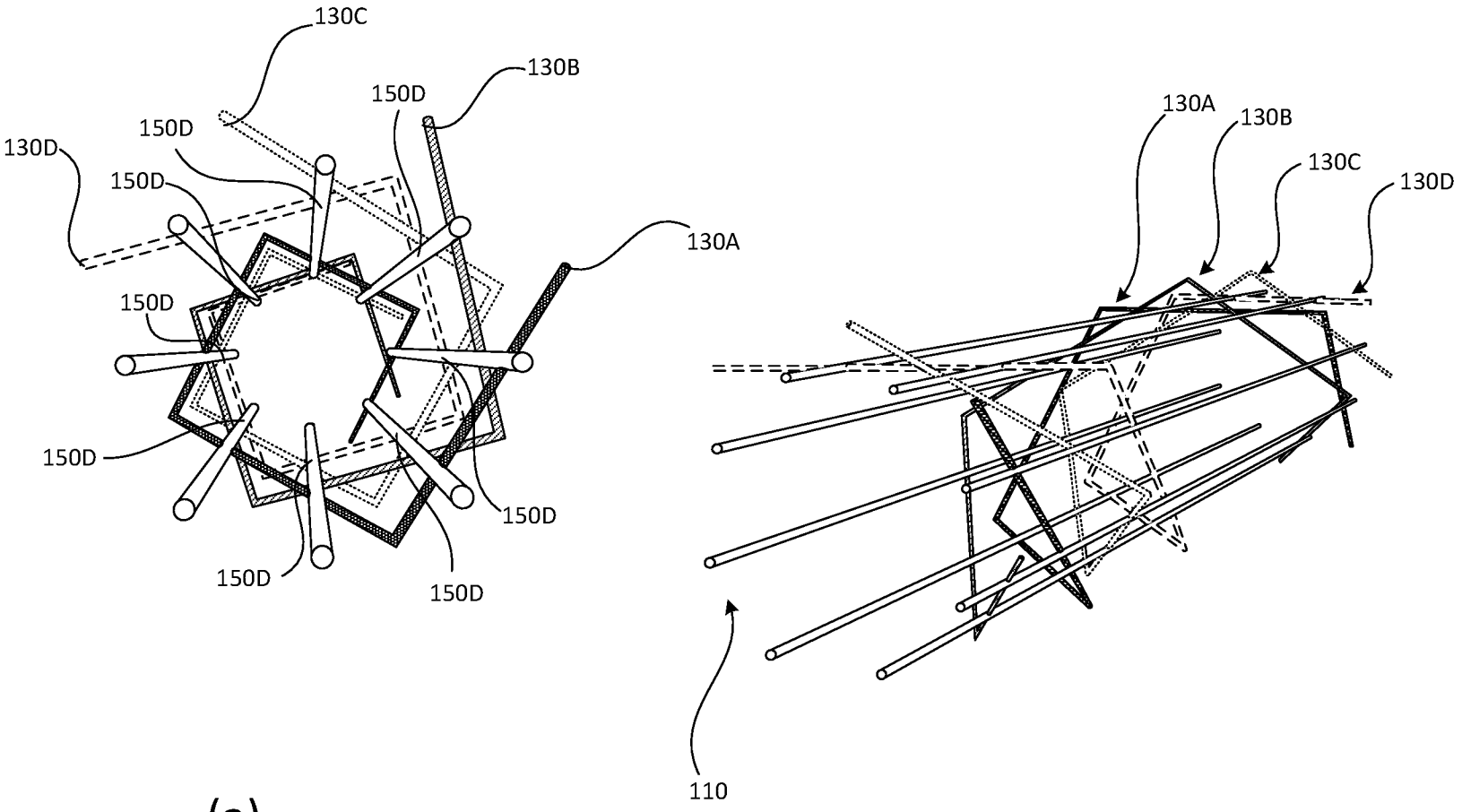
Figure 2E:
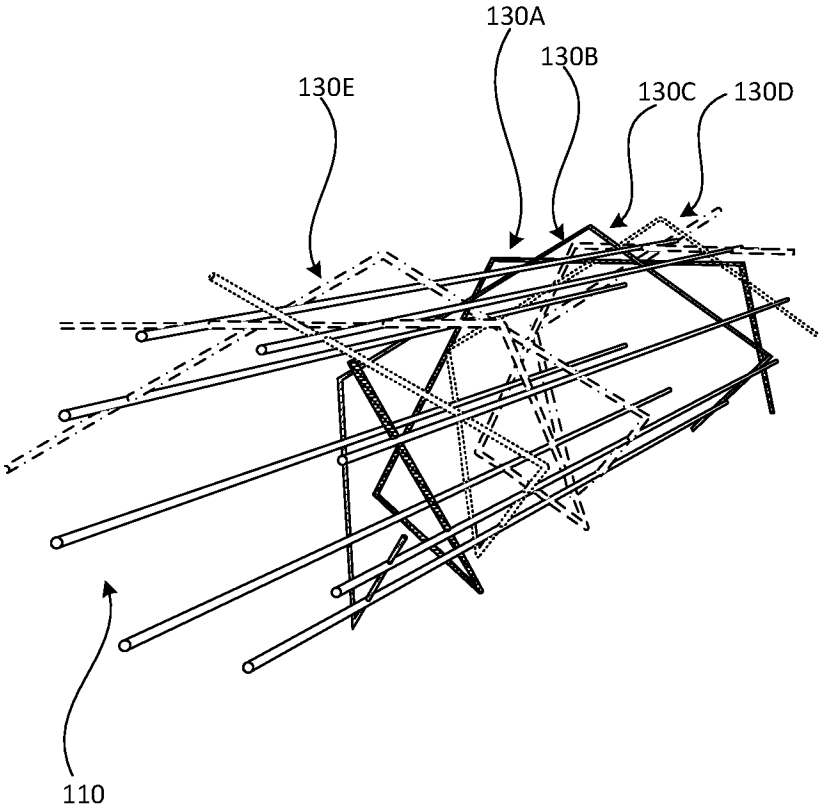
Figure 2E:
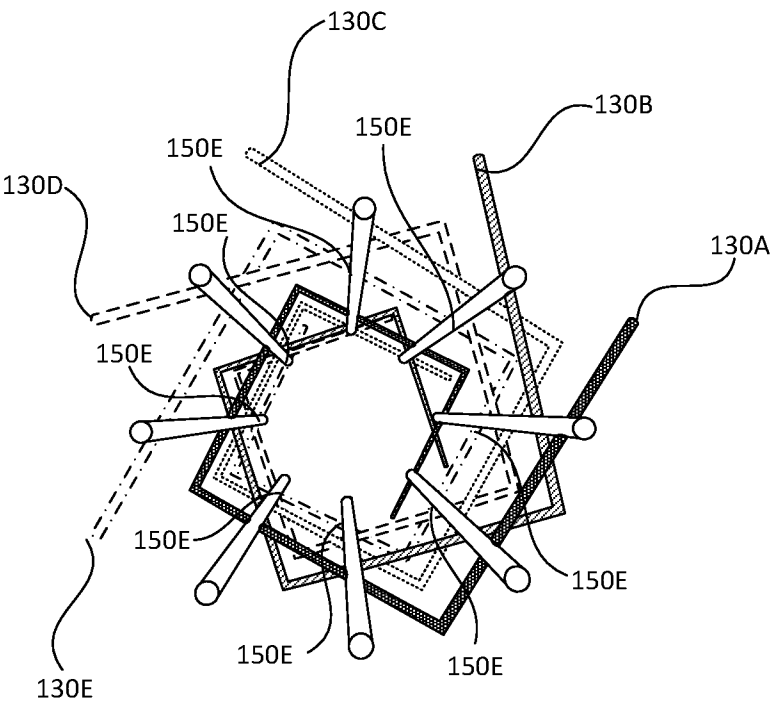
Figure 2F:
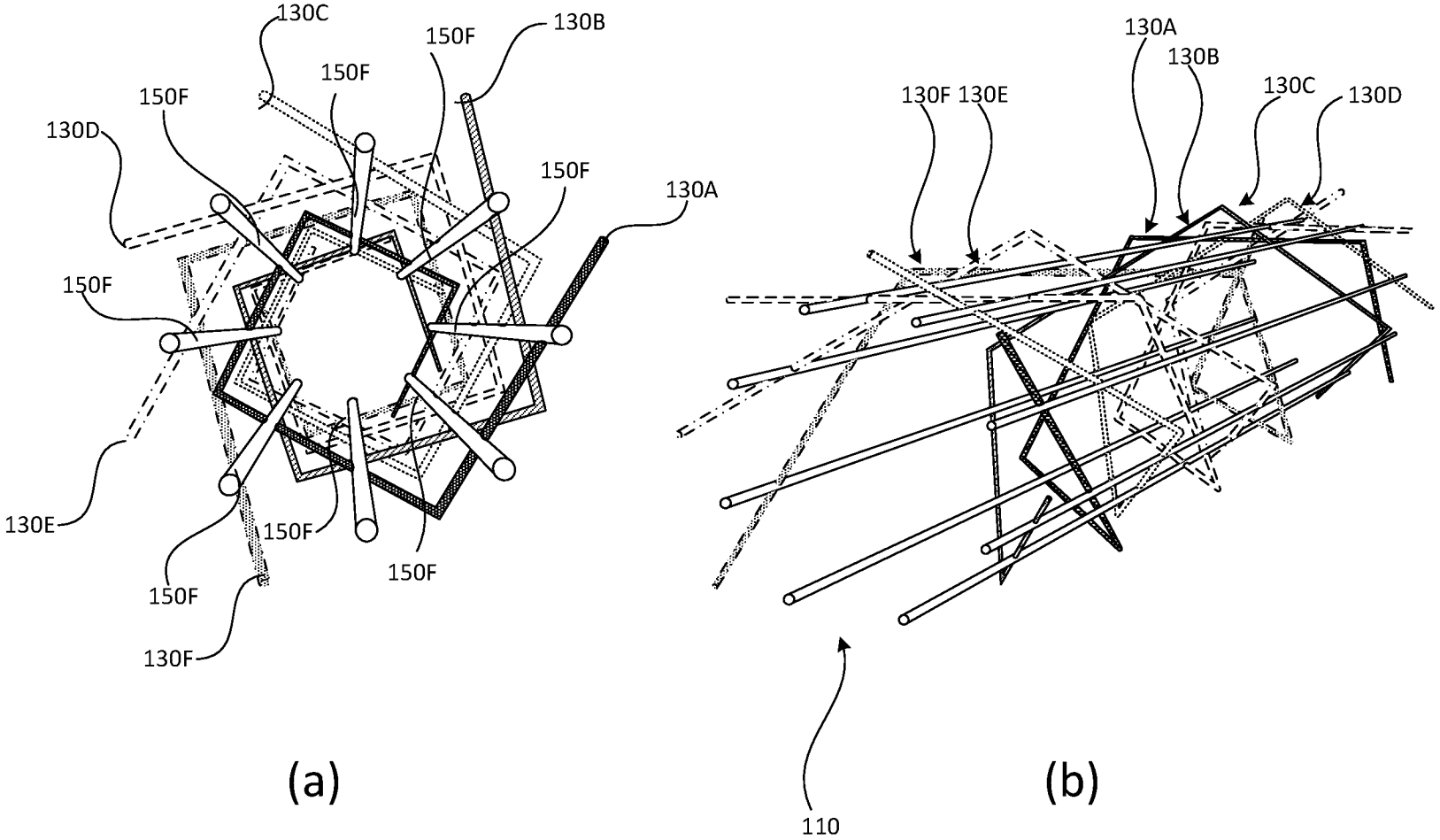
Figure 2G:
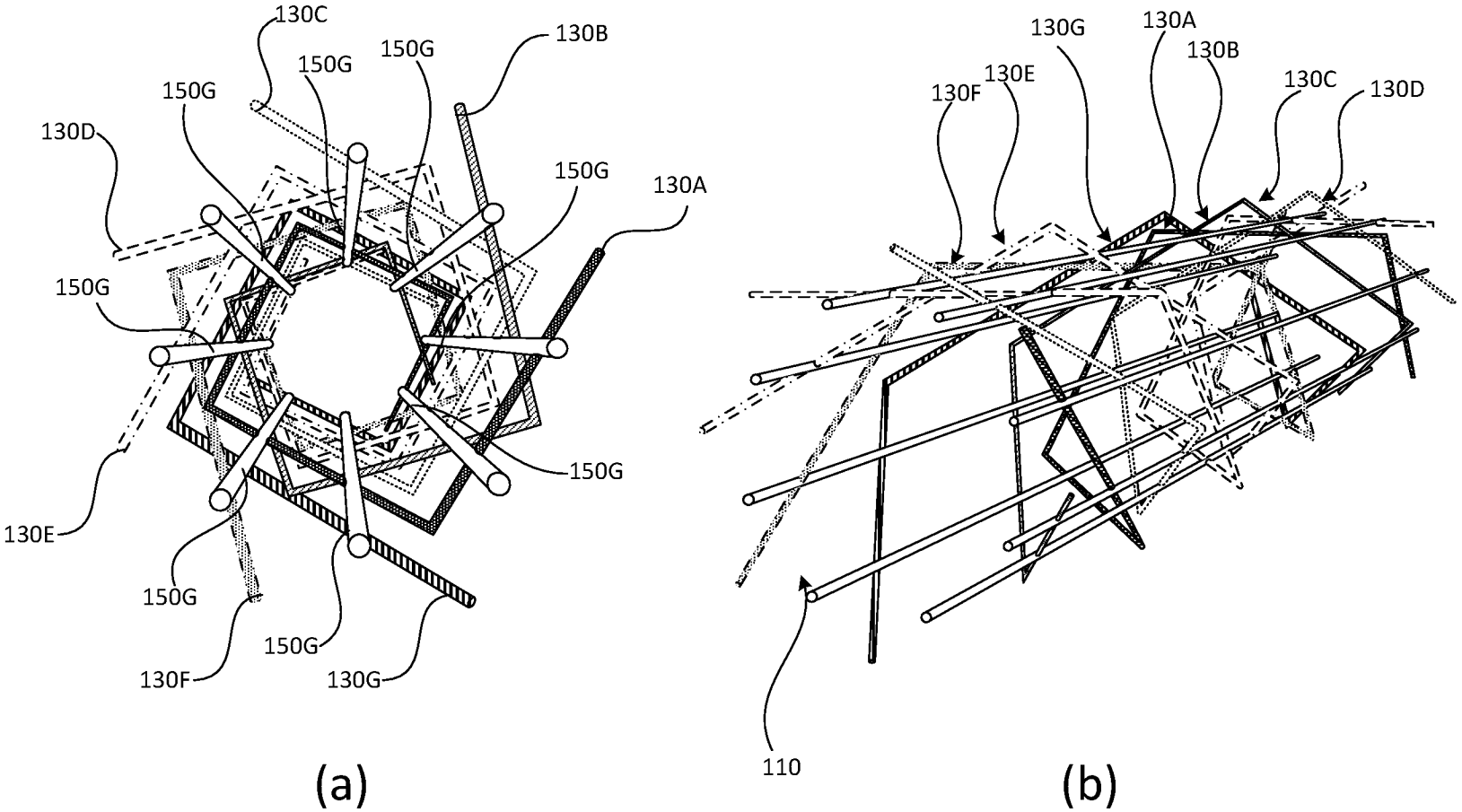

As shown in FIGS. 2A(a) and 2A(b), a first helical structure 130A may include a plurality of transverse members 120 arranged end to end to define the first helical structure 130A. Each of the transverse members 120 of the first helical structure 130A may be joined with respective longitudinal members 110 of the longitudinal frame at respective nodes 150A. FIGS. 2B(a) and 2B(b) illustrate a second helical structure 130B joined with the longitudinal members 120 of the longitudinal frame at respective nodes 150B. As shown in FIGS. 2B(a) and 2B(b), the second helical structure 130B may include a plurality of transverse members 120 arranged end to end to define the second helical structure 130B. Similarly, FIGS. 2C(a) and 2C(b) illustrate a third helical structure 130C, including a plurality of transverse members 120 arranged end to end, joined with the longitudinal members 120 of the longitudinal frame at respective nodes 150C; FIGS. 2D(a) and 2D(b) illustrate a fourth helical structure 130D, including a plurality of transverse members 120 arranged end to end, joined with the longitudinal members 120 of the longitudinal frame at respective nodes 150D; FIGS. 2E(a) and 2E(b) illustrate a fifth helical structure 130E, including a plurality of transverse members 120 arranged end to end, joined with the longitudinal members 120 of the longitudinal frame at respective nodes 150E; FIGS. 2F(a) and 2F(b) illustrate a sixth helical structure 130F, including a plurality of transverse members 120 arranged end to end, joined with the longitudinal members 120 of the longitudinal frame at respective nodes 150F; FIGS. 2G(a) and 2G(b) illustrates a seventh helical structure 130G, including a plurality of transverse members 120 arranged end to end, joined with the longitudinal members 120 of the longitudinal frame at respective nodes 150G; and FIGS. 2H(a) and 2H(b) illustrate an eighth helical structure 130H, including a plurality of transverse members 120 arranged end to end, joined with the longitudinal members 120 of the longitudinal frame at respective nodes 150H.

Figure 2H:
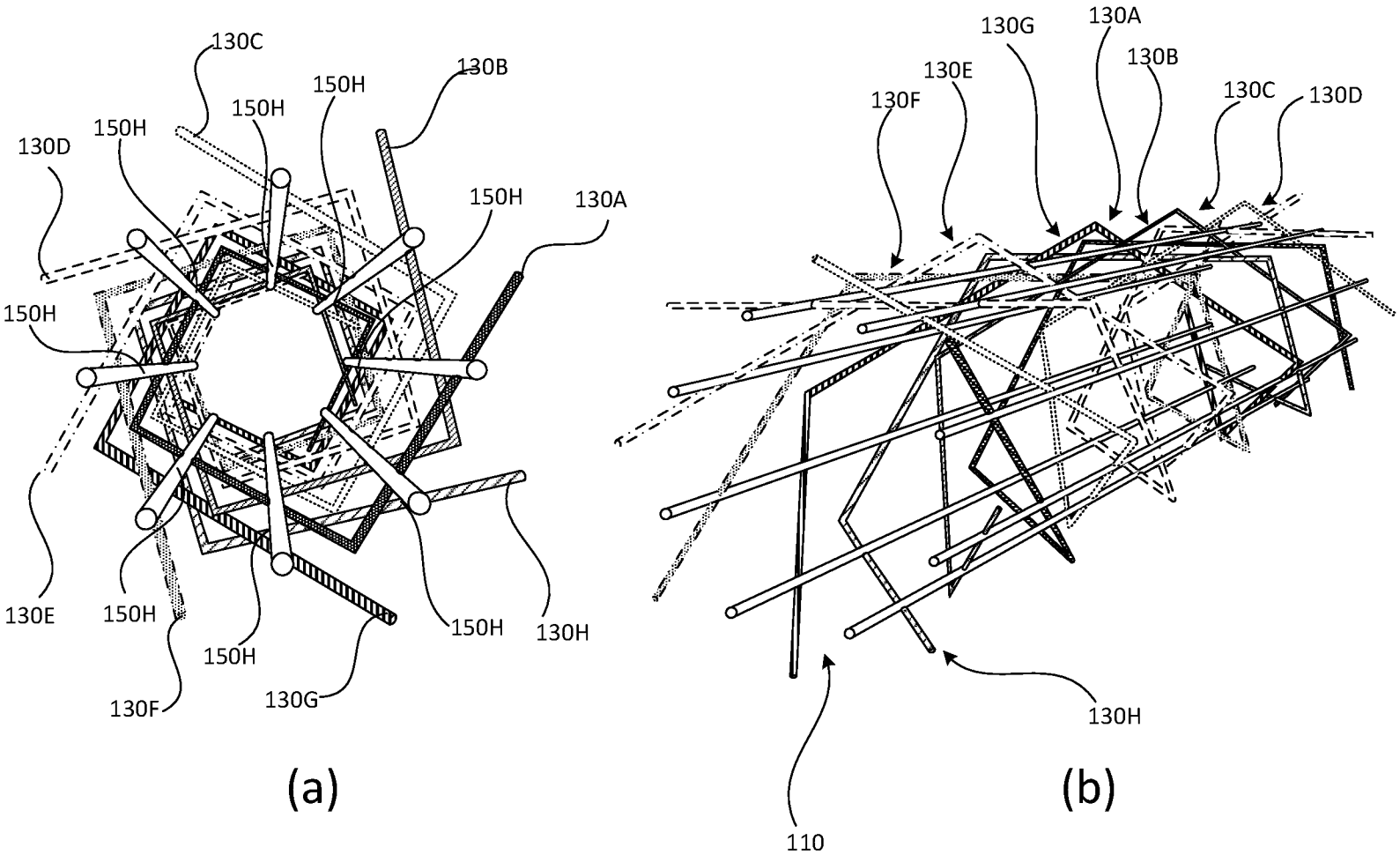

In the example arrangement shown in FIG. 2H, the transverse members 120 are arranged in eight helical structures 130A through 130H, each defining a somewhat square helical section, joined with eight longitudinal members 110 of the longitudinal frame to form the truss structure 100. However, the truss structure 100 may include more, or fewer, longitudinal members 110 and/or more, or fewer, helical structures 130 formed by the transverse members 120. For example, in some implementations, the truss structure 100 may include six longitudinal members 110. In a truss structure 100 including six longitudinal members 110, the helical structures 130 (each including transverse members 120 arranged end to end) may define somewhat triangular helical sections joined with the longitudinal members 110 at the respective nodes 150. In the example arrangement shown in FIG. 2H, the helical structures 130 are in a counter-clockwise arrangement with respect to the longitudinal members 110. However, in some implementations, the helical structures 130 may be in a clockwise arrangement with respect to the longitudinal members 110.

As noted above, the number of longitudinal members 110 and corresponding number of helical structures 130 (each defined by transverse members 120 arranged end to end) of a particular truss structure may vary based on, for example, an amount of load to be borne by the truss structure, a type of load, a distribution of load, a particular application and/or installation and/or environment in which the truss structure is to be used, and other such factors. In some situations, a truss structure including eight longitudinal members 110 may provide increased rigidity when compared to a truss structure including six longitudinal members 110. A mass of the truss structure including eight longitudinal members 110 may be positioned further (radially outward) from the central longitudinal axis A of the truss structure, when compared to the truss structure including six longitudinal members 110, resulting in a comparatively greater moment of inertia for the truss structure including eight longitudinal members 110. In some arrangements, in the truss structure including eight longitudinal members 110, the helical structures 130 maybe positioned further from the central longitudinal axis A than in the truss structure including six longitudinal members 110, providing for a comparatively greater torque carrying capability for the truss structure including eight longitudinal members 110.

In some implementations, a truss structure including eight longitudinal members 110 positioned at the outer peripheral portion of the truss structure may exhibit as much as 70% greater stiffness, or rigidity, than a comparably sized truss structure including six longitudinal members 110. In some implementations, a truss structure including eight longitudinal members 110 may exhibit as much as 40% to 50% greater torque capacity than a comparably sized truss structure including six longitudinal members 110.

In some implementations, the longitudinal members 110 and the transverse members 120 may be joined at mating end portions of the transverse members 120 (i.e., at a portion of the helical structure 130 in which a contour of the helical structure 130 changes direction). This may allow the longitudinal members 110 to be positioned at the greatest radial distance possible from the central longitudinal axis A. In some situations, this may enhance some of the overall load bearing characteristics of the truss structure 100. In some implementations, the longitudinal members 110 and the transverse members 120 may be joined at a straight portion of the transverse member 120. For example, in some implementations, the nodes 150 (at which the longitudinal members 110 and the transverse members 120 are joined) may occur at a straight portion of the helical structure 130 (i.e., a straight portion of the corresponding transverse member 120), where the helical structure 130 does not change direction, rather than at a portion of the helical structure 130 at which one transverse member 120 is joined to the next adjacent transverse member 120 and the contour of the helical structure 130 changes direction. In some implementations, connection of the transverse members 120 and the longitudinal members 110 at respective straight portions of the transverse members 120 may members 120 enhance the reinforcement of the buckling strength, or buckling resistance, of the longitudinal members 110, and thus enhance the overall strength, and buckling resistance, of the overall truss structure 100. Buckling strength of the truss structure 100 may also be affected by a longitudinal distance between nodes 150 along a longitudinal member 110. That is, buckling strength, or buckling resistance, of the longitudinal member 110, and of the overall truss structure 100, may be further enhanced, or increased, as a distance d (see FIG. 1B) between adjacent nodes 150 along the longitudinal member 110 is decreased.

In some implementations, a material from which the longitudinal members 110 and/or the transverse members are made may be selected, taking into account various different characteristics of the material (such as, for example, strength, weight, cost, availability and the like), together with required characteristics of the truss structure 100 (such as, for example, size, load bearing capability and the like). For example, in some implementations, the longitudinal members 110 and/or the transverse members 120 may be made of a carbon fiber type material, a glass type material, a basalt type material, a poly paraphenylene terephthalamide type material such as, for example, Kevlar® and other such materials and/or combinations of materials.

For example, in some implementations, the truss structure 100 having longitudinal members 110 and/or transverse members 120 including, for example, a carbon fiber material, or other such material as noted above, may be relatively light in weight relative to, for example, a comparable support structure made of, for example, a metal material such as steel, while being capable of bearing the same (or a greater) load than the comparable support structure made of a metal material. In another comparison, the truss structure 100 having longitudinal members 110 and/or transverse members 120 including this type of carbon fiber material may be considerably stronger than, for example, a comparable support structure made of, for example, a metal material, of essentially the same weight and/or size. For example, in some implementations, the truss structure 100 having longitudinal members 110 and/or transverse members 120, structured in the manner described herein, and including a carbon fiber material, or other such material as noted above, may be approximately ten times stronger, than a steel tube of essentially the same weight. A truss structure 100, in accordance with implementations described herein, may garner a considerable increase in strength from the material used for the longitudinal members 110 and/or the transverse member 120, in combination with the geometric structure defined by the arrangement of the longitudinal members 110 and the transverse members 120, and/or the geometric structure of the longitudinal members 110 and/or the transverse members 120 themselves.

In some implementations, a cross sectional shape of one or more of the longitudinal members may be, for example, circular, elliptical, triangular, square, rectangular, trapezoidal, and the like. In some implementations, all of the longitudinal members may have substantially the same cross sectional shape. In some implementations, a cross sectional shape of one or more of the transverse members defining the helical structures may be, for example, circular, elliptical, triangular, square, rectangular, trapezoidal, and the like. In some implementations, all of the transverse members/helical structures may have substantially the same cross sectional shape. In some implementations, the cross sectional shape of one or more of the longitudinal members may be substantially the same as the cross sectional shape as one or more of the transverse members/helical structures. In some implementations, the longitudinal members and the transverse members/helical structures may have different cross sectional shapes.

The example truss structures illustrated herein include eight longitudinal members, with transverse members arranged end to end in helical structures defining substantially square helical sections. However, a truss structure in accordance with implementations described herein, may include more, or fewer, longitudinal members, with the configuration of the transverse members forming the helical structures being adjusted accordingly.

As shown in FIGS. 3A-3E, the longitudinal members 110 having the triangular cross section may join, or intersect with, or be integrally formed with, the transverse members 120 forming the helical structures 130 at a respective plurality of nodes 150. In some implementations, the longitudinal members 110 and the transverse members 120 may be integrally joined at the nodes 150. For example, in some implementations, the longitudinal members 110 and the transverse members 120 may be made of a carbon fiber material. The carbon fiber material of the longitudinal members 110 and the transverse members 120 may include, for example, a plurality of strands that woven together to form a node 150 that integrally couples, or joins, the corresponding longitudinal member 110 and transverse member 120. For example, strands of the longitudinal member(s) 110 may be alternately arranged with the strands of the transverse member(s) 120 at the nodes 150, thus interweaving the longitudinal members 110 and the transverse members 120 at the nodes 150, and creating a substantially integral truss structure 200 from the longitudinal members 110 and the transverse members 120. In some implementations, this arrangement of the strands of the material of the longitudinal member 110 and the strands of the material of the transverse member 120 may be guided by features of a manufacturing fixture.

Figure 3A:
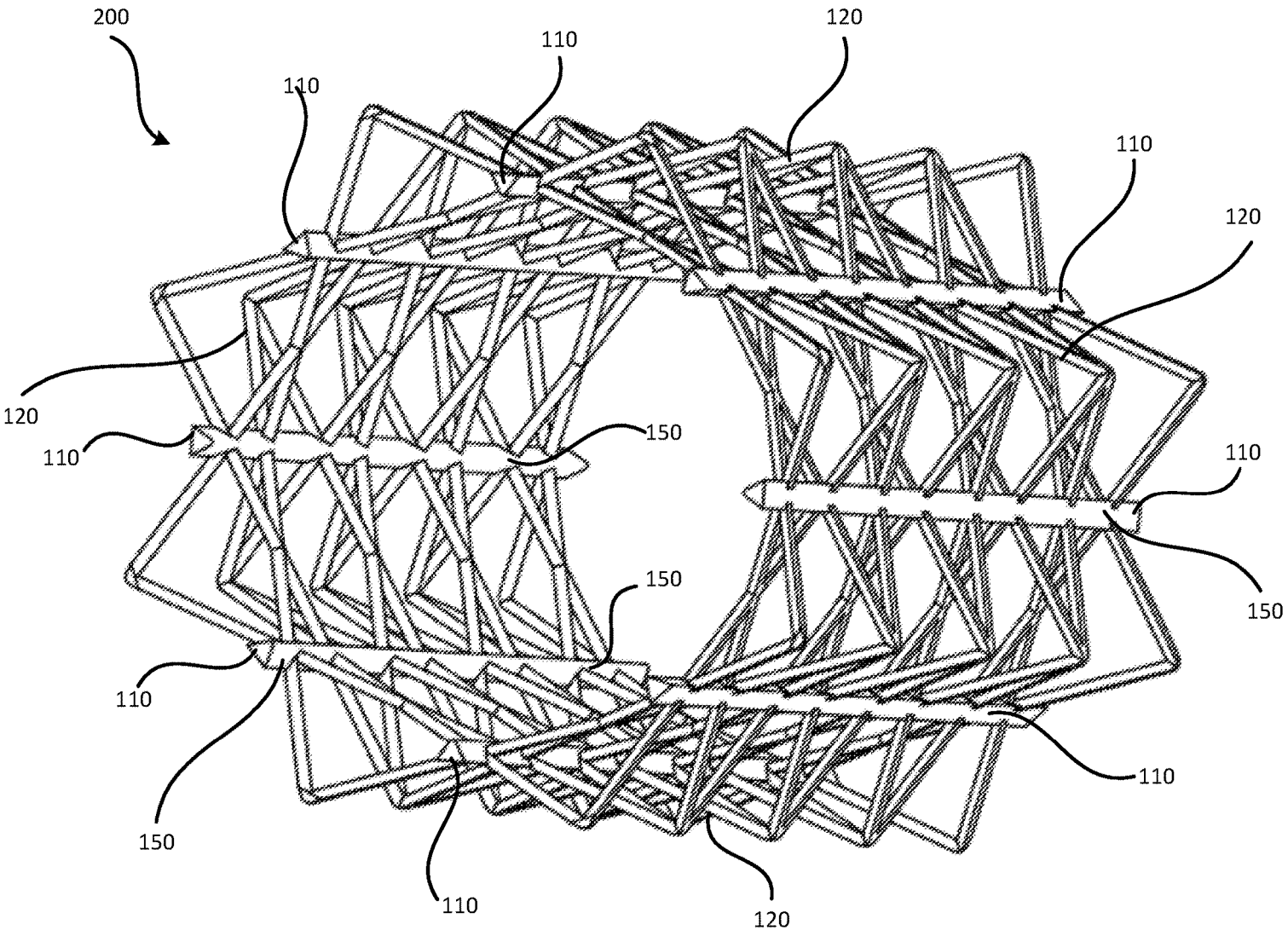
FIG. 3A is a perspective view.
Figure 3B:
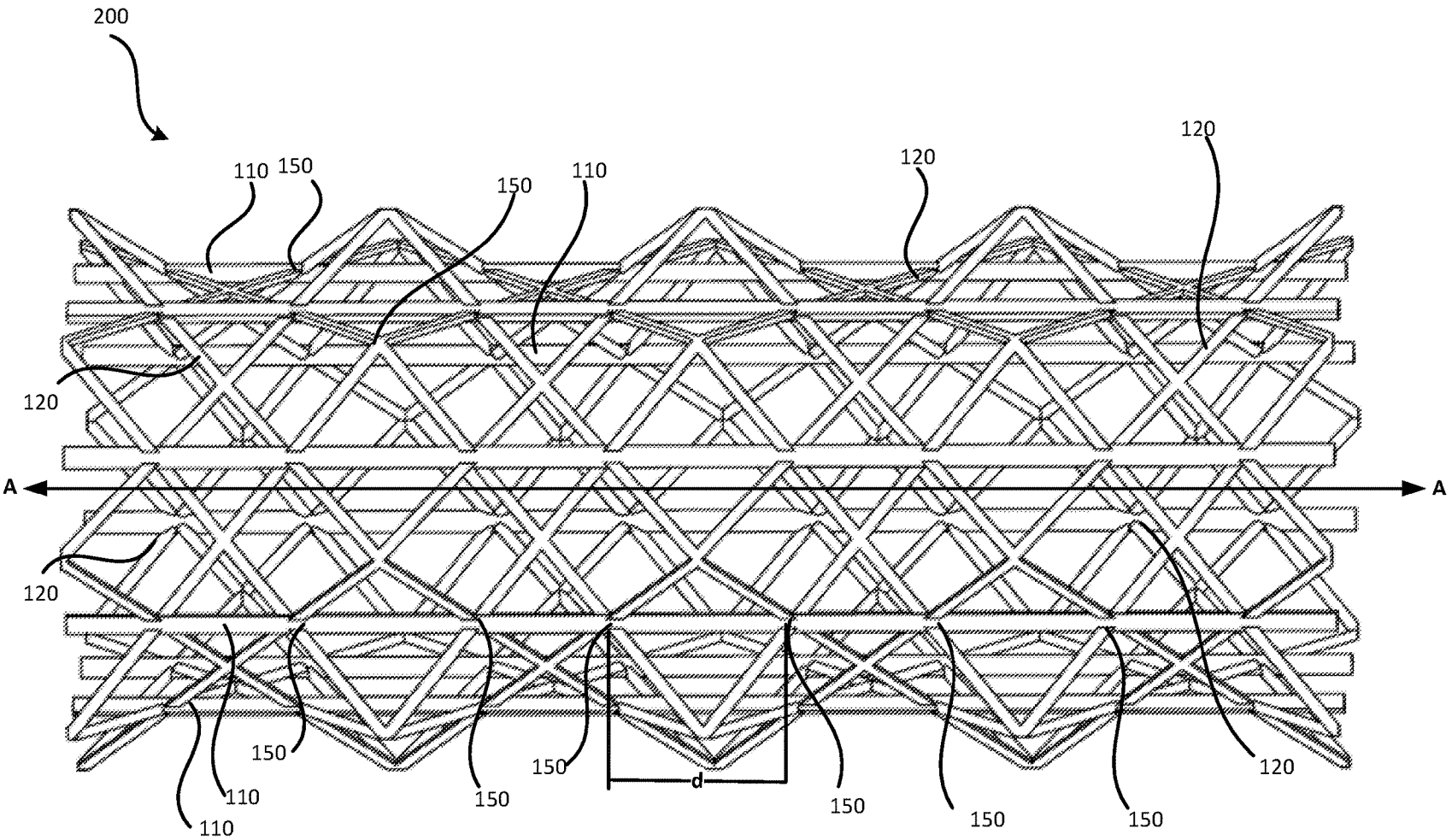
FIG. 3B is a side view.
Figure 3C:
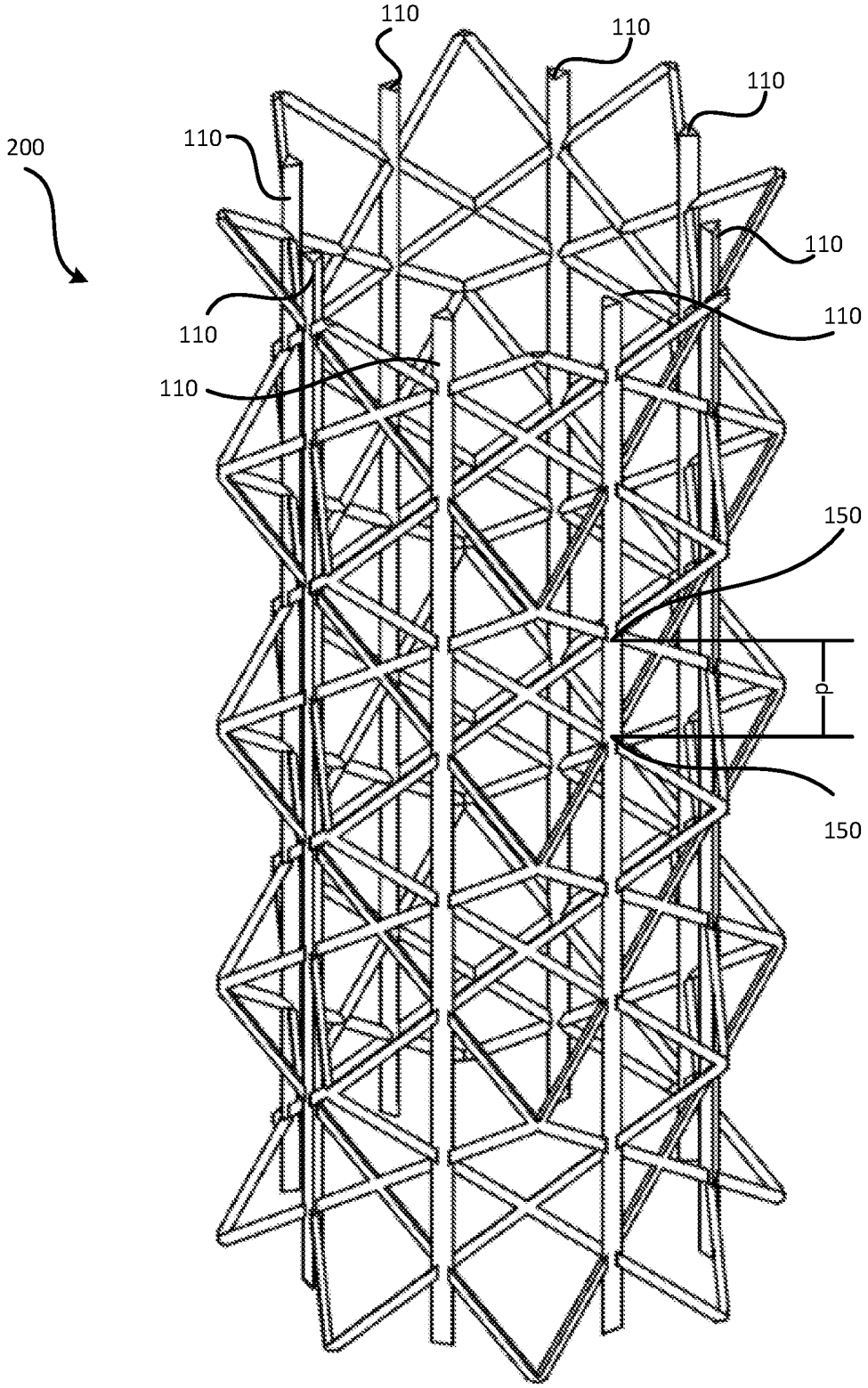
FIG. 3C is an isometric view.
Figure 3D:
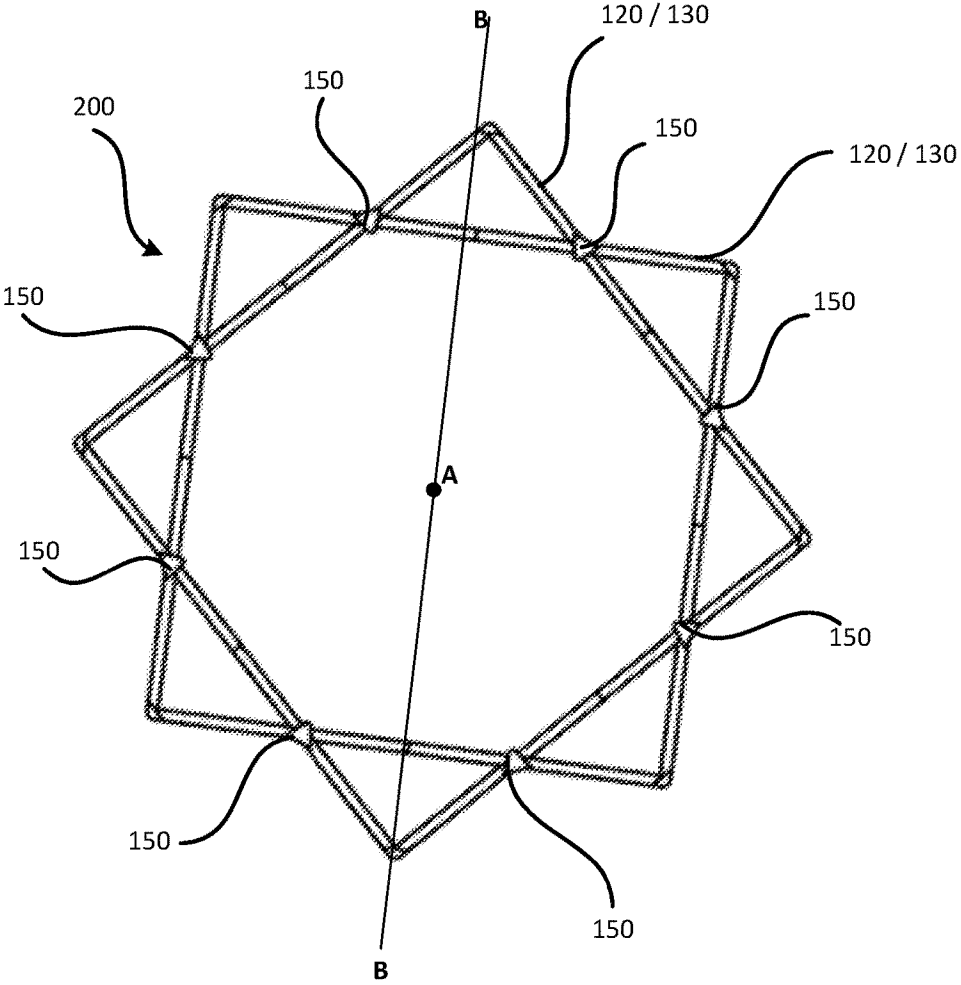
FIG. 3D is an axial end view, of an example truss structure, in accordance with implementations described herein.
Figure 3E:
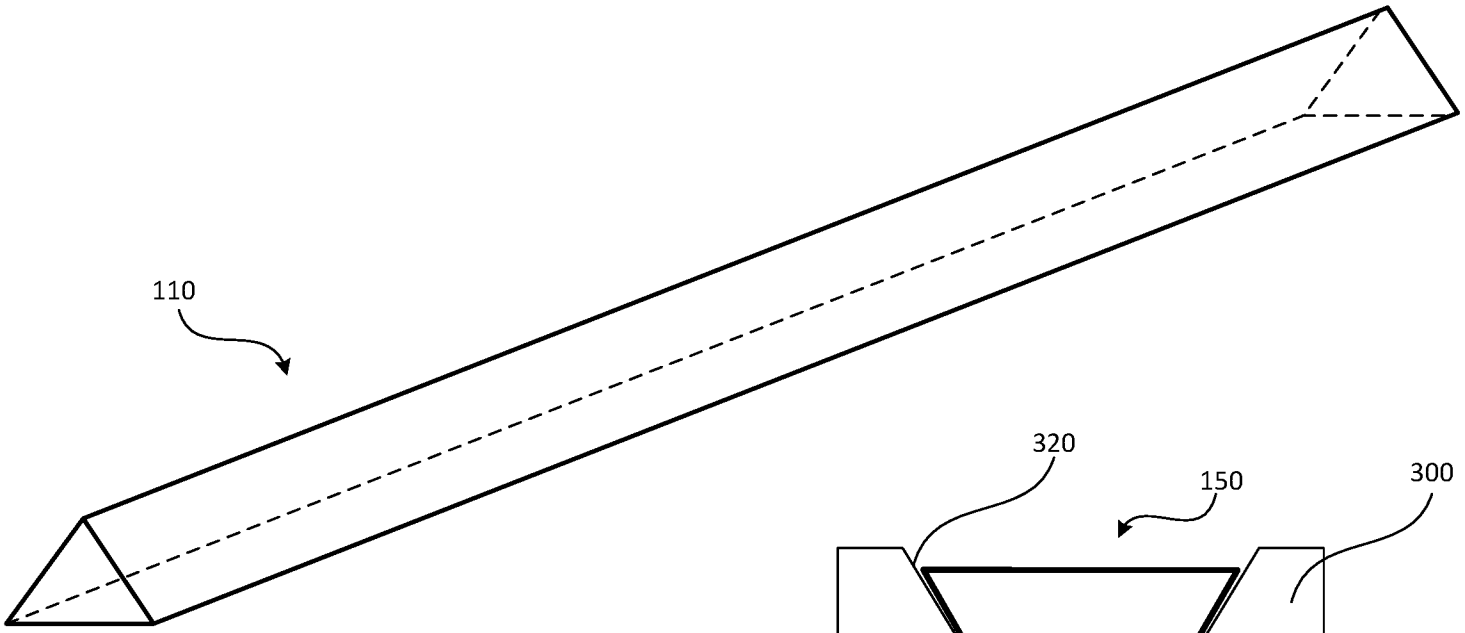
FIG. 3E illustrates an example longitudinal member of an example truss structure.
Figure 3F:
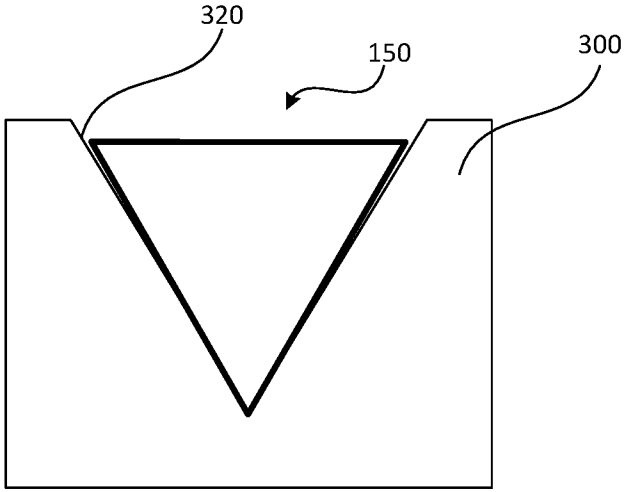
FIG. 3F is a cross sectional view of a portion of an example truss structure in an example manufacturing fixture.

For example, in some implementations, the strands of the material of the longitudinal member(s) 110 and the strands of the material of the transverse members 120 may be laid up, or woven, on a manufacturing fixture 300 including grooves 320, or pockets, at points defining the nodes 150, as shown in FIG. 3F. The strands of the longitudinal member(s) 110 and the strands of the transverse member(s) 120 may be alternately arranged in these grooves in the fixture, to achieve the interweaving of the strands of the longitudinal member(s) 110 and the strands of the transverse member(s) 120, and the resulting integral structure of the truss structure 200.

Figure 5:
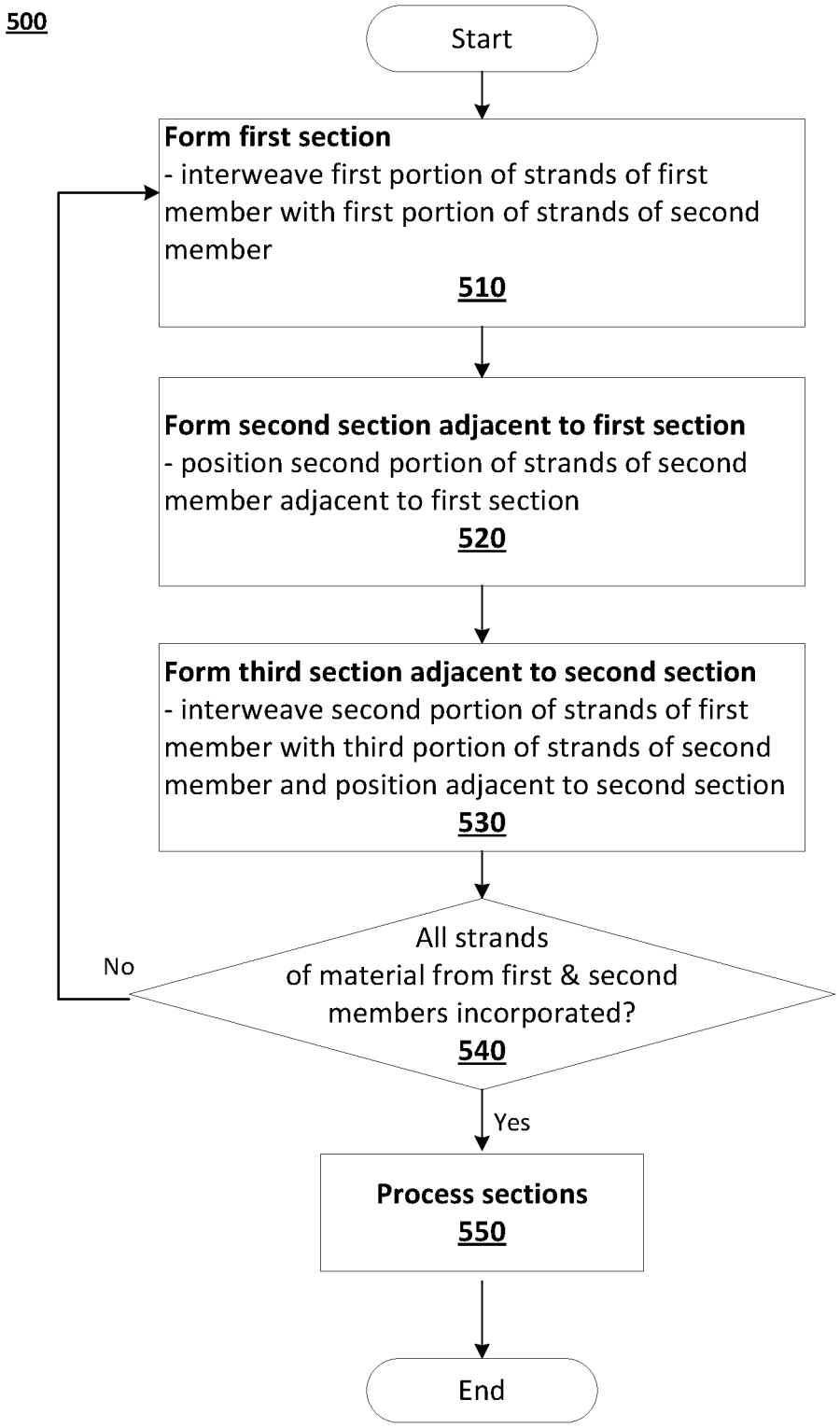
FIG. 5 is a flowchart of an example method of joining an example longitudinal member and an example transverse member, in accordance with implementations described herein.

An example of a method 500 of joining the longitudinal member(s) 110 and the transverse member(s) 120, or forming node(s) 150 at the intersection of the longitudinal member(s) 110 and the transverse member(s) 120 by, for example, a lay-up and/or interweaving of strands or fibers of materials of the longitudinal member(s) 110 and transverse member(s) 120, is shown in FIG. 5. In some implementations, the method 500 may include an alternating layering of the strands or fibers of a first member (for example, one of the longitudinal member 110 or the transverse member 120) with a second member (for example, the other of the longitudinal member 110 or the transverse member) in, for example, a recess or groove of a fixture.

For example, in some implementations, the method 500 may include forming a first section of the node 150 (block 510). In some implementations, the first section of the node 150 may include an interweaving of strands or fibers from the material of the first member with strands or fibers from the material of the second member. For example, the first section may include an interweaving of (a portion of) strands from the first member with (a portion of) strands from the second member. In some implementations, a second section of the node 150 may be formed adjacent to the first section of the node 150 (block 520). In some implementations, the second section may include a laying-in of (a portion of) the strands of the second member (either alone, or together with a portion of the strands of the first member) adjacent to the first section. In some implementations, a third section of the node 150 may be formed adjacent to the second section of the node 150 (block 530). In some implementations, the third section may include an interweaving of a (remaining) portion of the strands of the first member with a (remaining) portion of the strands of the second member. The layering of adjacent sections of the node 150 may include more, or fewer sections than discussed in this example, and/or different combinations of interwoven strands of the first and second members, and/or different sequencing of the strands of the first and second members. The layering of adjacent sections of the node 150 with strands of material from the first member and the second member may continue until it is determined that all of the strands of material have been incorporated into the node 150 (block 540). In some implementations, the layers or sections of material received in the recess or groove in this manner may be compressed in the recess or groove, to, for example, facilitate the reduction and/or elimination of voids. In some implementations, for example, when the material of the first member and/or the second member is pre-impregnated with an epoxy/resin material, the material received in the recess or groove in this manner may then be processed, for example, cured, to join the first member and the second member in an interwoven, or integral manner (block 550).

Figure 3G:
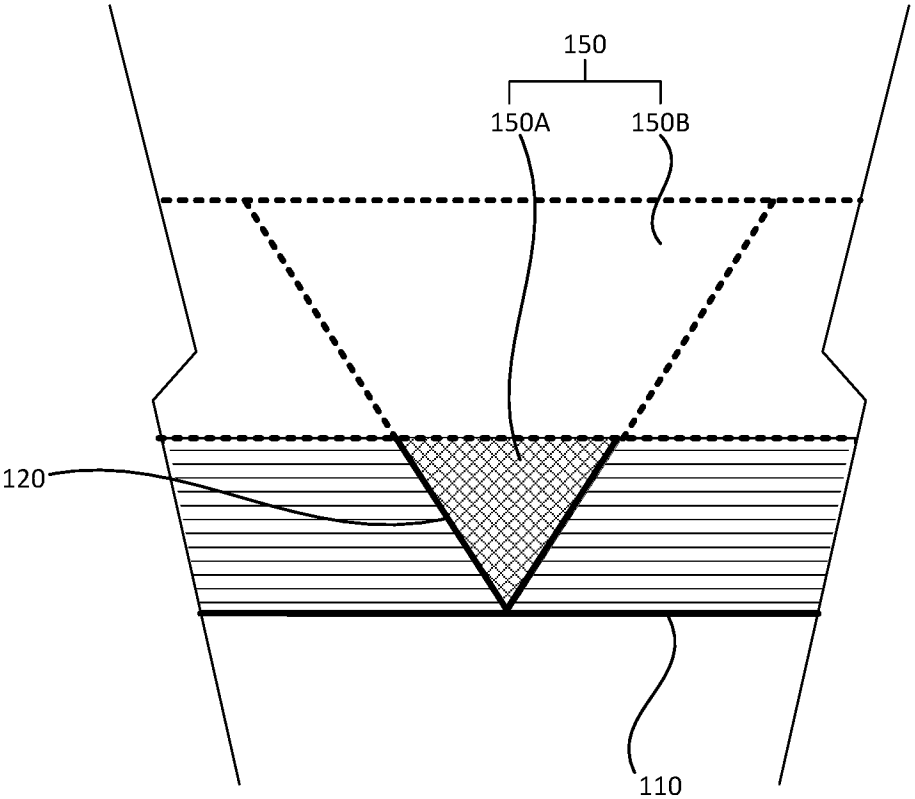
FIG. 3G is a cross sectional view of a node of an example truss structure, in accordance with implementations described herein.
Figure 4A:
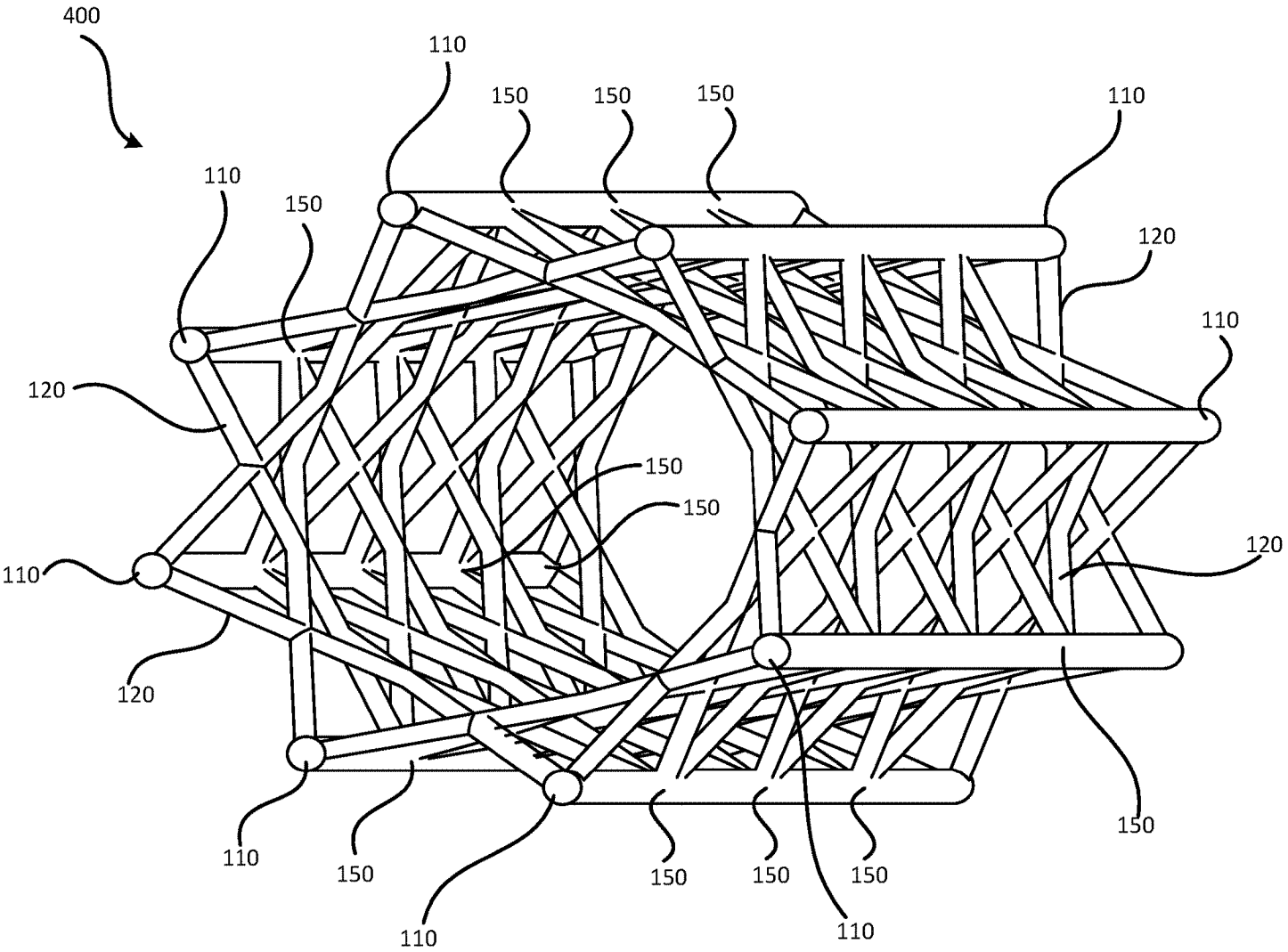
FIG. 4A is a perspective view.
Figure 4B:
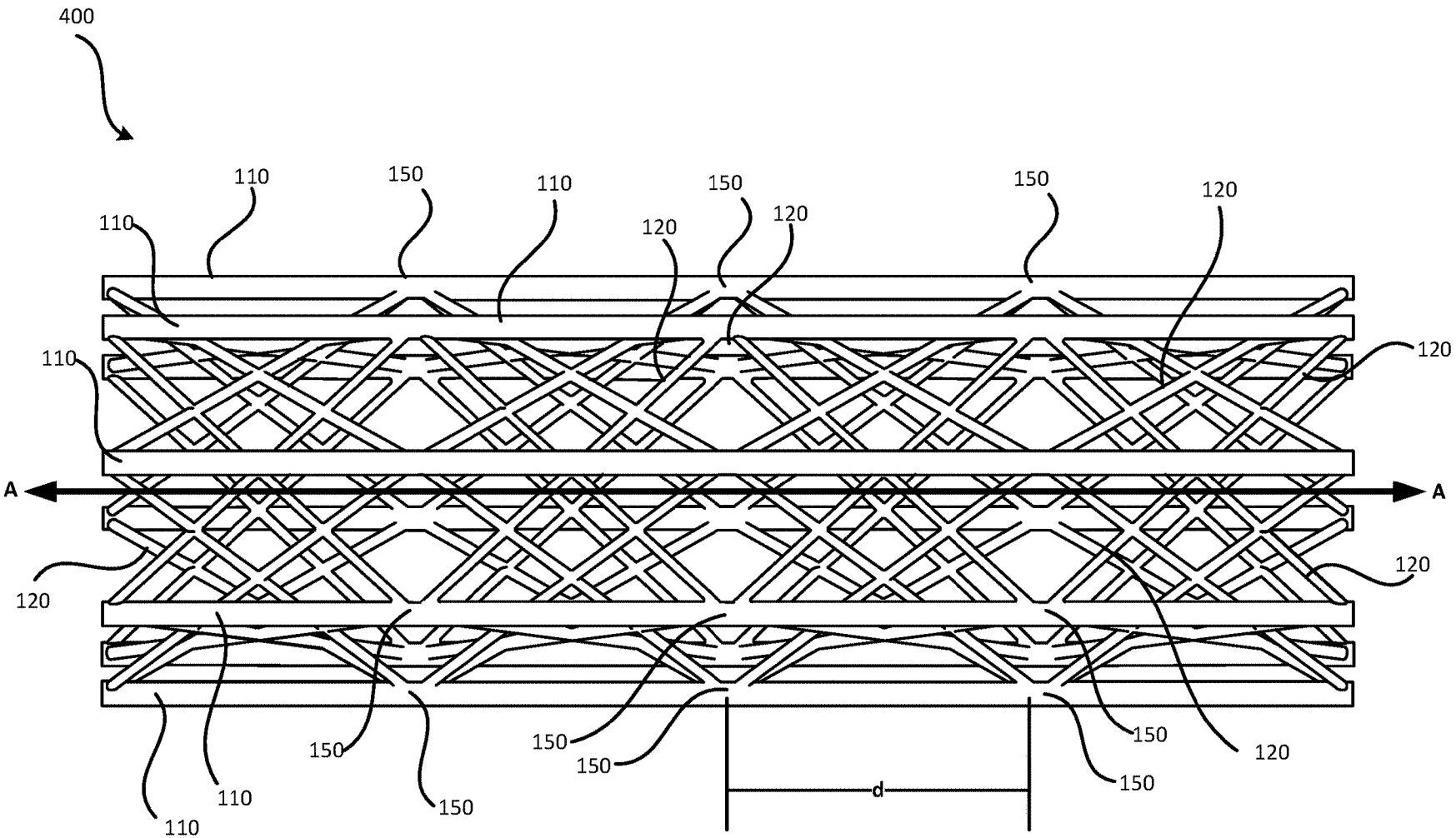
FIG. 4B is a side view.
Figure 4C:
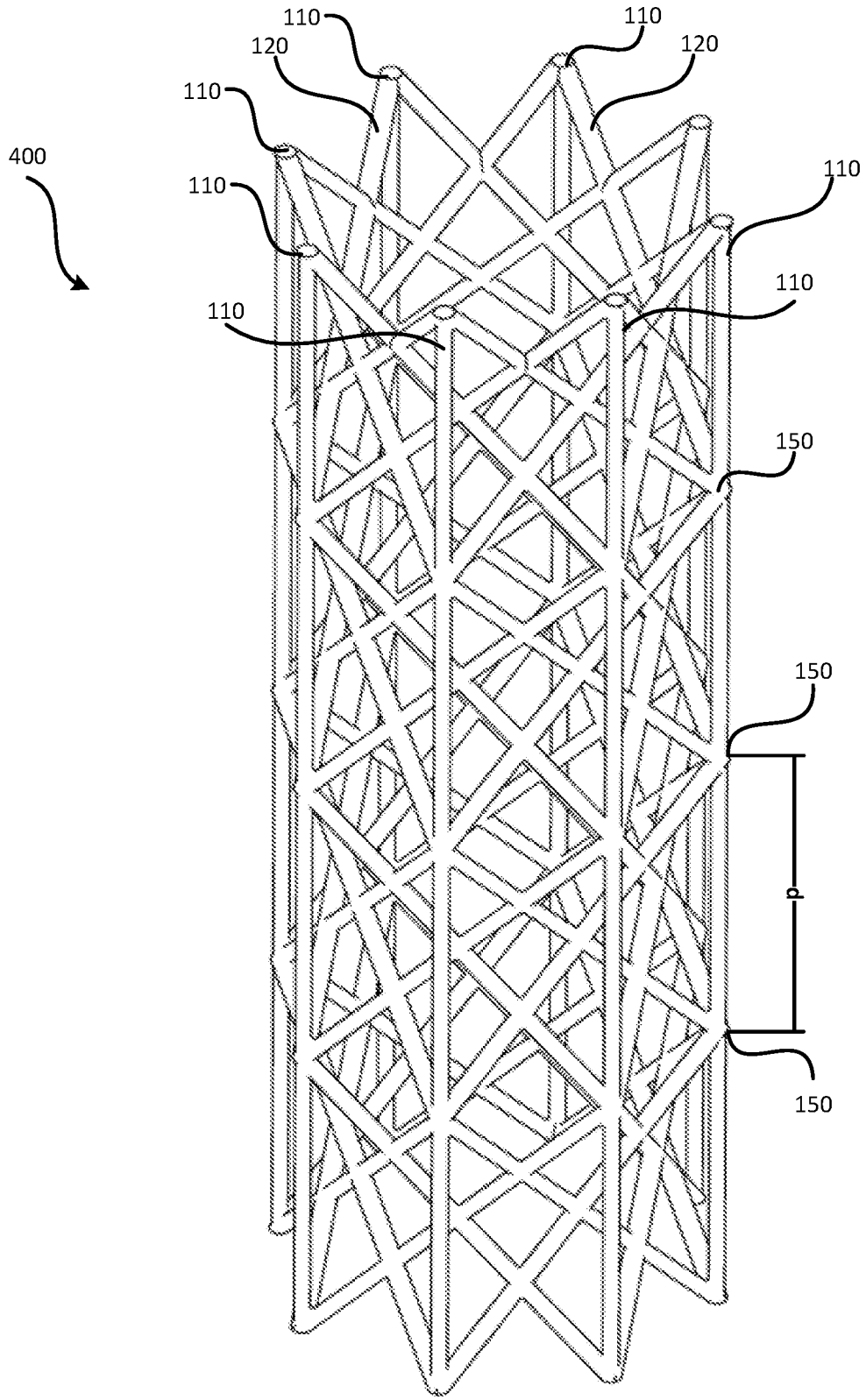
FIG. 4C is an isometric view.
Figure 4D:
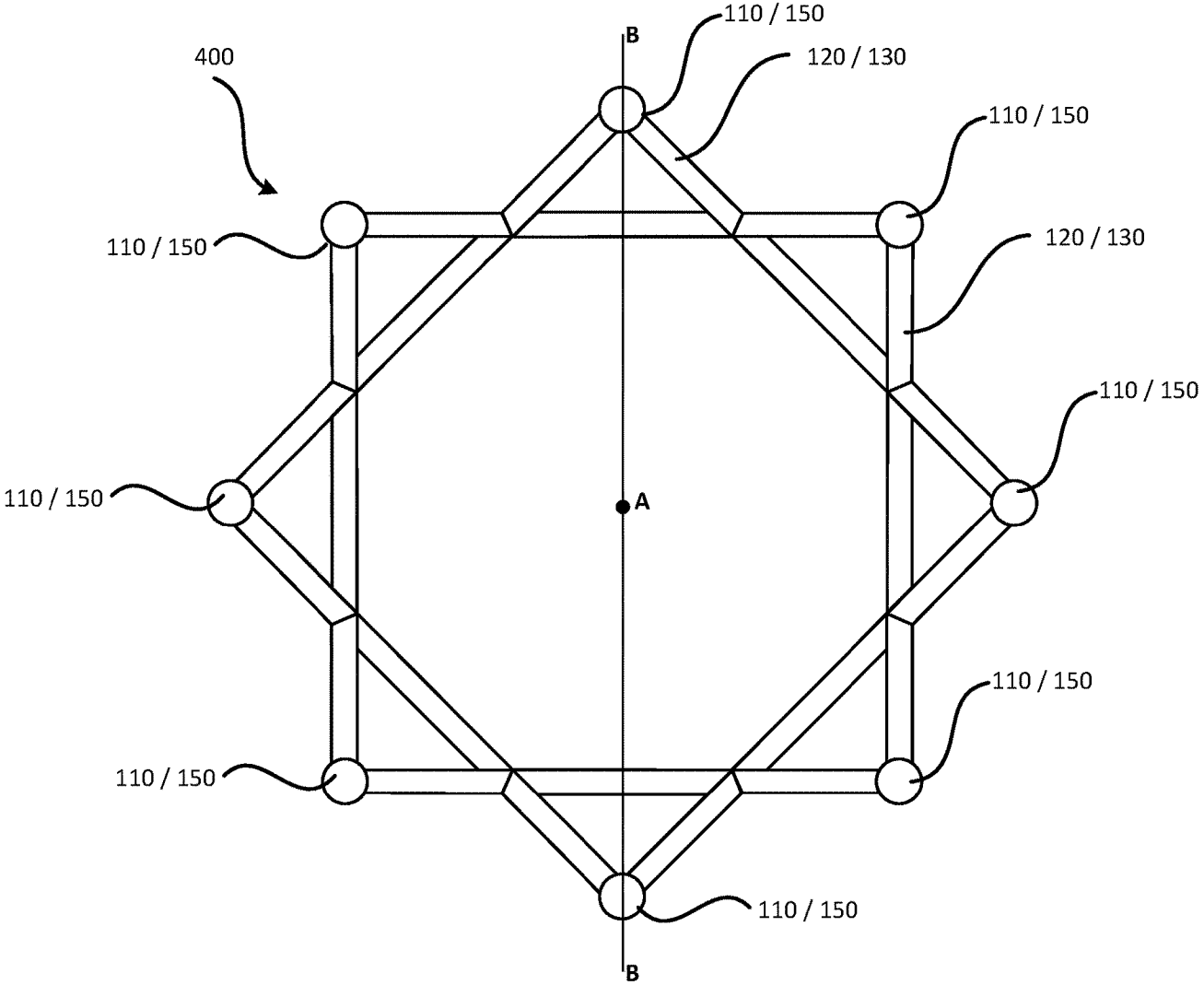
FIG. 4D is an axial end view, of an example truss structure, with longitudinal members being positioned at an outer peripheral portion of the example truss structure, in accordance with implementations described herein.
Figure 4F:
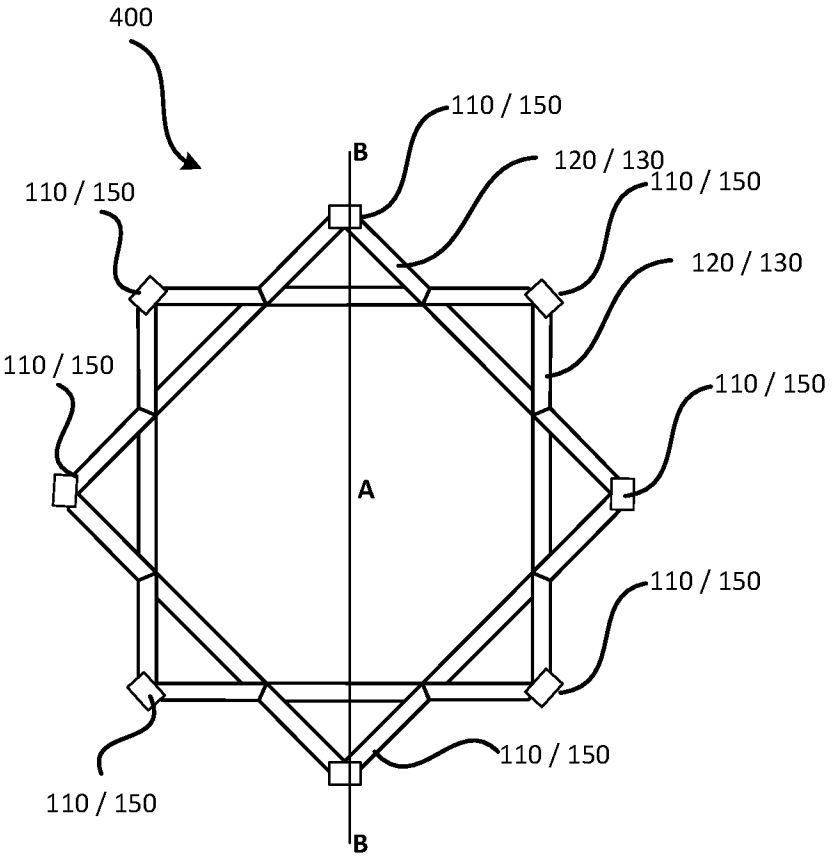
FIGS. 4E-4F are axial end views of example truss structures, with longitudinal members being positioned at an outer peripheral portion of the example truss structures, in accordance with implementations described herein.
Figure 4E:
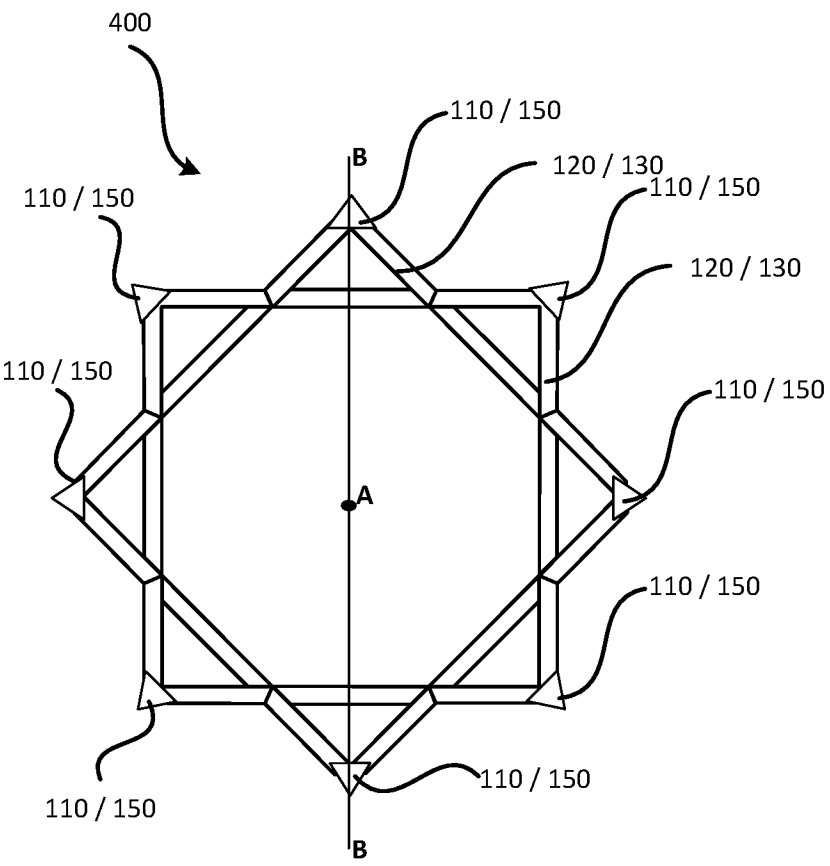

An example node 150, joining a longitudinal member 110 and a transverse member 120 (of one of the helical structures 130 of the truss structure 200), is shown in FIG. 3G. The example node 150 may include a first section 150A, which is formed by an interweaving of strands of material of the longitudinal member 110 and strands of material of the transverse member 120. The first section 150 of the example node 150, is illustrated by FIG. 3G by cross-hatching, to represent the interweaving of the respective strands. Various different patterns, or alternating arrangements, of strands may be implemented to accomplish this interweaving. The example node 150 may also include a second section 150B, positioned adjacent to the first section 150. In the example node 150 shown in FIG. 3G, the second section 150B of the node 150 has not yet been formed. The second section 150B may be made of the remaining strands of the material of the longitudinal member 110 and the remaining strands of material of the transverse member 120. The pattern, or arrangement of the respective strands in the second section 150B of the node 150 may be different from that of the first section 150A, or may be the same as that of the first section 150A. In some implementations, the second section 150B of the node 150 may include multiple sub-sections or layers, having multiple different arrangements of strands of the materials of the longitudinal member 110 and the transverse member 120.

In a first, non-limiting example of this type of alternating lay up of the fibers, or strands, of the longitudinal members 110 and the transverse members 120 in the groove defining the node 150 may include a weaving of approximately 25% of the strands of the longitudinal member 110 with approximately 50% of the stands of the transverse member 120, followed by approximately 50% of the strands of the longitudinal member 110, and then followed by a weaving of the remaining approximately 25% of the strands of the longitudinal member 110 with the remaining approximately 50% of the strands of the transverse member 120. This is just one example of an alternating layup of the strands of the longitudinal members 110 and the transverse members 120 in the groove defining the node 150. Other combinations of alternating carbon fiber material within the grooves of the fixture defining the nodes 150 may also be used, based on, for example, a size and/or shape and/or configuration of the truss structure 200, a type of material used for the longitudinal members 110 and/or the transverse members 120, a load to be carried by the truss structure 200, a geometric configuration of the helical structures 130, a cross sectional shape of the transverse members 120, and other such factors.

For example, in a second, non-limiting example of this type of alternating lay up of the fibers, or strands, of the longitudinal members 110 and the transverse members 120 in the groove defining the node 150 may include a relatively straightforward, consistent, repeated alternating layup, or weaving, of the strands of the longitudinal member 110 and the strands of the transverse member 120 at the node 150. This could include, for example, a layup at the node of a strand from the longitudinal member 110 followed by a strand from the transverse member 120, and then another strand from the longitudinal member 110 followed by another strand from the transverse member 120, repeating this pattern until all of the strands of the longitudinal member 110 and all of the strands of the transverse member 120 have been incorporated at the node 150. This example pattern is not necessarily limited to a repeated alternating pattern of a single strand from the longitudinal member 110, followed by a single strand from the transverse member 120. Rather, this example pattern could include a repeated alternating pattern of multiple strands from the longitudinal member 110 followed by (the same number of) multiple strands from the transverse member 120.

The first and second examples presented above may be applied in an arrangement in which, for example, a number of tows, or strands, in the helical structures 130 formed by the transverse members 120 would be half that of the longitudinal members 110. For example, the example (completed) truss structure illustrated in FIGS. 2A-2H includes eight longitudinal members 110, and sixteen helical structures 130 formed by the transverse members 120. If each of the helical structures 130 includes half the number of tows, or strands, of the longitudinal members 120, the first and second examples presented above may produce nodes 150 which incorporate all of the strands from the longitudinal members 110 and the transverse members 120 at each node 150. However, in some implementations, a third non-limiting example may include a pattern in which a ratio of longitudinal members 110 to helical structures 130 is not necessarily two to one. For example, in a truss structure which includes a three to one ratio of longitudinal members 110 to helical structures 130, a lay up pattern at the node 150 may include, for example, two strands from the helical structures 130 (one from each direction), followed by three strands from the longitudinal member 110, followed by another two strands from the helical structure 130, followed by another three strands from the longitudinal member 110, until all of the strands from the longitudinal member 110 and the helical structure 130 are incorporated at the node 150.

As noted above, these are just some examples of alternating layups of the strands of the longitudinal members 110 and the transverse members 120 forming the helical structures 130 in the groove defining the node 150. Other combinations of alternating carbon fiber material within the grooves of the fixture defining the nodes 150 may also be used, based on, for example, a size and/or shape and/or configuration of the truss structure, a type of material used for the longitudinal members 110 and/or the transverse members 120 forming the helical structures 130, a load to be carried by the truss structure, a geometric configuration of the helical structures 130, a cross sectional shape of the transverse members 120, and other such factors.

In some implementations, grooves 320 (for example, a series of grooves 320) in the manufacturing fixture 300 defining the longitudinal member(s) 110 and/or the transverse member(s) 120 and/or the nodes 150 at which the longitudinal member(s) 110 and the transverse member(s) 120 intersect, may have a V shape, as shown in the example illustrated in FIG. 3F. Layup of the fibers, or strands, of the carbon fiber material of the longitudinal member(s) 110 and the transverse member(s) 120 in the V groove 320, for example, in the manner described above, may facilitate layup of the carbon fiber material in the V groove 320, may enhance compaction, or consolidation, of the material in the V groove 320, and may produce the substantially triangular cross section shown in FIGS. 3E and 3F. In some implementations, the carbon fiber material may be pre-impregnated (pre-preg) with an epoxy resin material. Interwoven layup of the strands of pre-preg carbon fiber material in the V grooves 320 in the manner described above, having enhanced compaction in the V groove 320, followed by curing of the pre-preg carbon fiber material, may produce longitudinal member(s) 110 and/or transverse member(s) 120 and/or nodes 150 having a relatively low void ratio along the length of the truss structure 200 (i.e., the longitudinal members 110 and the transverse members 120 of the truss structure 200).

Longitudinal members 110 having a triangular cross sectional shape as described above may be produced using less material than longitudinal members 200 having other cross sectional shapes (for example, circular or rectangular/square cross sectional shapes), while providing at least equal, and in most circumstances, greater load bearing capability. The unexpected increase in load bearing capability provided by the longitudinal members 110 having the triangular cross section described above, when compared to truss structures with longitudinal members having other cross sectional shapes, is illustrated in Table 1 below. In particular, in one example, a truss structure with longitudinal members having a square cross section exhibited approximately 4.7% more load bearing capability than a comparable truss structure with longitudinal members having a circular cross section. In one example, a truss structure with longitudinal members having a triangular cross section exhibited approximately 20.9% more load bearing capability than comparable a truss structure with longitudinal members having a circular cross section. This significant, and unexpected, magnitude of improvement exhibited by the truss structure 200 with longitudinal members 110 having a triangular cross section may be due to improved local buckling resistance (buckling between two adjacent nodes 150 along a longitudinal member 110) and increased moment of inertia.

As noted above, one mode of failure of a truss structure 100 in accordance with implementations described herein may include buckling of individual longitudinal members 110. The ability of an individual longitudinal member 110 to resist bending and/or buckling may be directly proportional to an area moment of inertia of the longitudinal member 110. That is, by increasing moment of inertia, stiffness may be increased, thus reducing deflection of the truss structure under a given load. Table 1 below illustrates the difference in area moment of inertia for three different exemplary longitudinal members 110, each having a different cross sectional shape (i.e., circular, triangular, and square), holding an amount of material, of the cross sectional area, of the longitudinal members 110 constant for the three examples. As shown in Table 1, a longitudinal member having a triangular cross section may exhibit an increase in area moment of inertia of approximately 20.9% (compared to a longitudinal member 110 having a circular cross section of the same cross sectional area), affording the longitudinal member 110 having the triangular cross section an approximately 20.9% improvement in buckling strength over the longitudinal member 110 having the circular cross section. Similarly, a longitudinal member having a square cross sectional shape may exhibit an approximately 4.7% improvement in buckling resistance over a longitudinal member 110 having a circular cross section.

TABLE 1

| | Circular | Triangular | Square |
|---|---|---|---|
| Cross sectional area (in^2) | 1 | 1 | 1 |
| Moment of Inertia (in^4) | 0.07957747155 | 0.09621333333 | 0.08333333333 |
| % difference in moment of inertia related to circular | 0 | 20.90524047 | 4.71975512 |

In the example truss structure 200 described above, the longitudinal members 110 have a triangular cross sectional shape. In some implementations, all of the longitudinal members 200 have a triangular cross sectional shape. In some implementations, some, or all, of the transverse members 120 defining the helical structures 130 have a triangular cross sectional shape. In some implementations, some, or all, of the transverse members 120 defining the helical structures 130 have a cross sectional shape that is different than the triangular cross sectional shape of the longitudinal members 110.

Hereinafter, a truss structure 400, in accordance with implementations described herein, may include a plurality of longitudinal members 110 positioned along an outer peripheral portion of the truss structure 400, will be described with reference to FIGS. 4A-4F. Positioning of the longitudinal members 110 along the outer peripheral portion of the truss structure 400 may enhance load bearing strength of the truss structure 400 (by, for example, increasing buckling strength/resistance), and may increase moment of inertia of the truss structure 400. In particular, by positioning the longitudinal members 110 at an outer peripheral portion of the truss structure 400 (rather than, for example, an interior facing side portion of the helical structures 130), moment of inertia for the truss structure 400 may be increased. This may allow the truss structure 400 shown in FIGS. 4A-4F to carry a greater load (when compared to, for example, an interior side positioning of the longitudinal members 110 relative to the transverse members 120 of the helical structures 130), or to carry essentially the same load while utilizing less material in the manufacture of the truss structure 400. In some situations, or some arrangements of the longitudinal members 110, positioning of the longitudinal members 110 at the outer peripheral portion of the truss structure 400 in this manner may increase the moment of inertia of the truss structure 400 by as much as approximately 70%.

In the example truss structure 400 shown in FIGS. 4A-4D, the longitudinal members 110 are positioned at an outer peripheral portion of the truss structure 400, and have a circular cross sectional shape. In the example truss structure 400 shown in FIG. 4E, the longitudinal members 110 are positioned at an outer peripheral portion of the truss structure 400, and have a triangular cross sectional shape. In the example truss structure 400 shown in FIG. 4F, the longitudinal members 110 are positioned at an outer peripheral portion of the truss structure 400, and have a rectangular cross sectional shape. As noted above, the longitudinal members 110 may have other cross sectional shapes.

Regardless of the cross sectional shape of the longitudinal members 110, positioning of the longitudinal members 110 at the outer peripheral portion of the truss structure 400 may increase overall strength (for example, buckling resistance) of the truss structure 400, and may increase moment of inertia of the truss structure 400. Overall strength of the truss structure 400 may be further enhanced based on a type of material used for the longitudinal members 110 and/or the transverse members 120, as described in detail above. Overall strength of the truss structure 400 may be further enhanced by the improved compaction, and improved void ratio, afforded by the triangular cross sectional shape as described above. Increased strength of the truss structure 400 may enhance utility of the truss structure 400, provide for use of the truss structure 400 in a variety of different environments, and expand on applications for use of the truss structure 400.

Figure 6A:
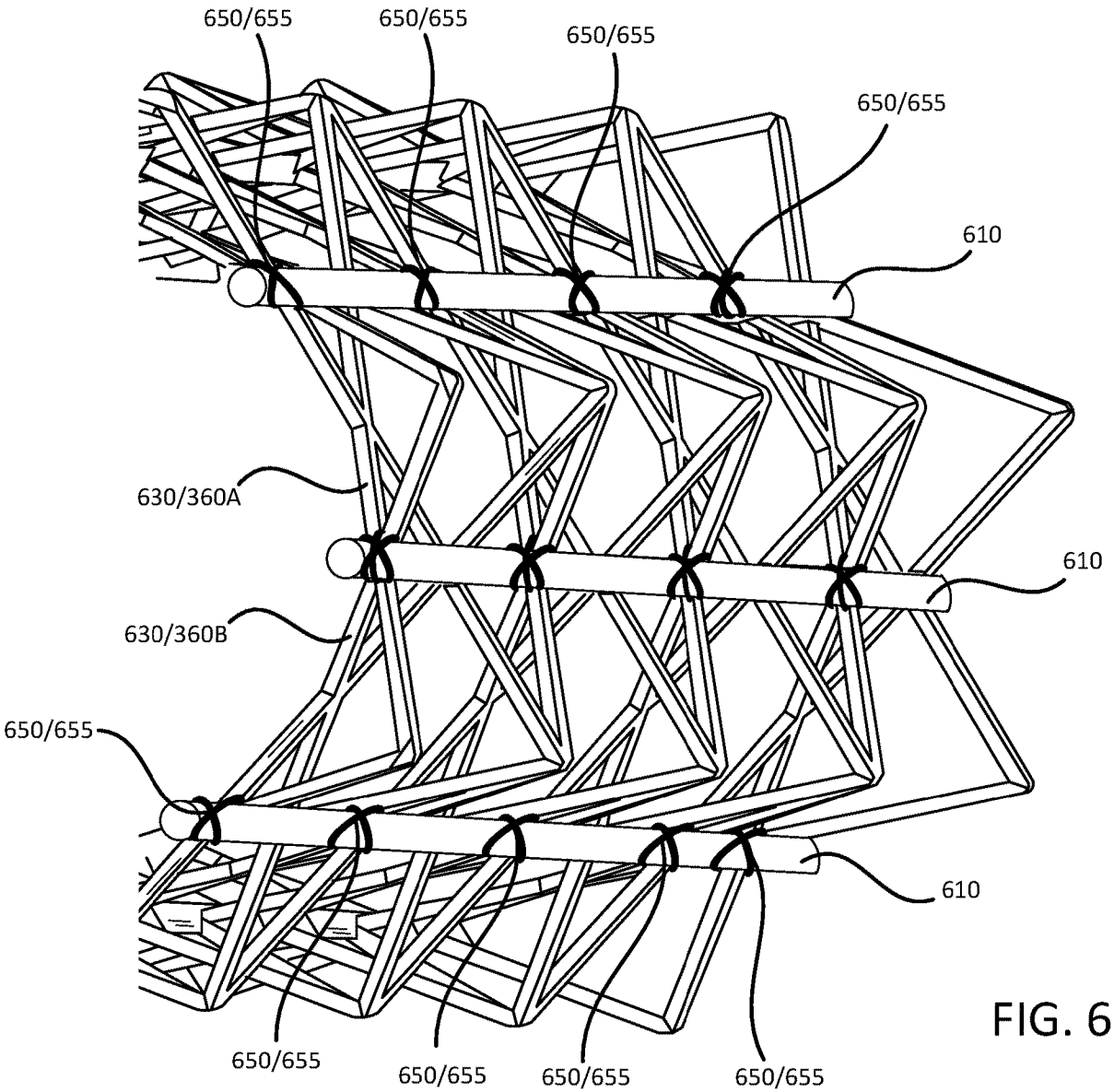
FIG. 6A is a partial perspective view of an exemplary truss structure, in accordance with implementations described herein.
Figure 6B:
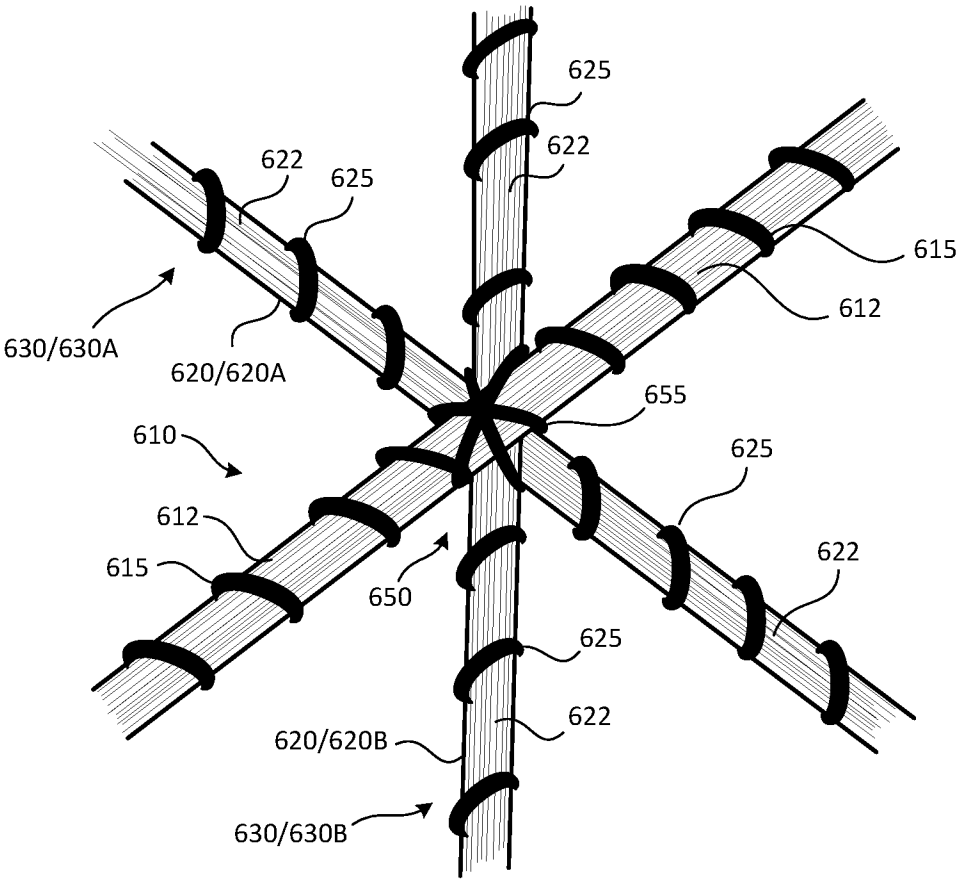
FIG. 6B is a close up view of an exemplary node of the exemplary truss structure shown in FIG. 6A, in accordance with implementations described herein.

FIG. 6A is a partial perspective view of an exemplary truss structure 600, in accordance with implementations described herein, and FIG. 6B is a close up view of an exemplary node 650 of the exemplary truss structure 600 shown in FIG. 6A, in accordance with implementations described herein. As shown in FIGS. 6A and 6B, the exemplary truss structure 600 may include a plurality of longitudinal members 610. The plurality of longitudinal members 610 may be arranged in parallel to each other, and may be arranged in parallel with the central longitudinal axis A of the truss structure 600, as described above in detail with reference to FIGS. 1A-1D. In some implementations, the longitudinal members 610 may be arranged symmetrically about any one of a plurality of different central planes extending through the central longitudinal axis A of the truss structure 600, such as, for example, the exemplary central plane B, as described above in detail with reference to FIGS. 1A-1D. A plurality of transverse 620 members may be arranged end to end, defining a plurality of helical structures 630. The plurality of helical structures 630 (defined by the plurality of transverse members 620) may be coupled to the plurality of longitudinal members at a plurality of nodes 650. In some implementations, the nodes 650 may be defined at a location at which one or more helical structures 630 meet, or overlap with, a longitudinal member 610. In the example shown in FIGS. 6A and 6B, two helical structures 630 and one longitudinal member 610 meet, or overlap, at each node 650.

In some implementations, each of the longitudinal members 610 and/or each of the transverse members 620 may be made of a high strength fiber filament material. For example, in some implementations, each of the longitudinal members 610 and/or each of the transverse members 620 may each include a respective plurality of fibers and/or filaments and/or strands, such as, for example, carbon fiber filaments, or other such material as noted above. The plurality of filaments may be arranged substantially longitudinally, for example, in tows, along the length of the respective longitudinal member 610 and/or transverse member 620. The arrangement of longitudinal tows may be wrapped, or bound, or lashed, or held together with a binding, or wrapping material. For example, in some implementations, the plurality of filaments arranged in tows may be bound, or wrapped, by a band made of a carbon fiber material, a poly paraphenylene terephthalamide type material such as, for example, Kevlar®, and the like.

The exemplary longitudinal members 610 shown in FIGS. 6A and 6B may include a plurality of filaments 612, for example, carbon fiber filaments arranged in tows, and arranged longitudinally to define the longitudinal member 610. The tows of filaments 612 may be bound, or wrapped, or held together by a banding material 615, or a wrapping material 615. In some implementations, the banding material 615, or wrapping material 615, may be made of, for example, a carbon fiber material, a poly paraphenylene terephthalamide type material such as, for example, Kevlar®, an industrial grade shrink wrapping material, and other such materials which may be appropriate for a particular carbon fiber filament material and/or an environment in which the truss structure 600 is to be installed. The binding, or wrapping, of the tows of filaments 612 with the banding or wrapping material 615 may provide for compression, or compaction, of the tows of filaments 612, particularly during curing, or hardening, of the longitudinal members 610. Similarly, the exemplary transverse members 620 defining the helical structures 630 shown in FIGS. 6A and 6B may include a plurality of filaments 622, for example, carbon fiber filaments arranged in tows, and arranged longitudinally to define each of the transverse members 620 of the helical structures 630. The tows of filaments 622 may be bound, or wrapped, or held together by a banding material 625, or a wrapping material 625. In some implementations, the banding material 625, or wrapping material 625, may be made of, for example, a carbon fiber material, a poly paraphenylene terephthalamide material, an industrial grade shrink wrapping material, and other such materials which may be appropriate for a particular carbon fiber filament material and/or an environment in which the truss structure 600 is to be installed. The binding, or wrapping, of the tows of filaments 622 with the banding or wrapping material 625 may provide for compression, or compaction, of the tows of filaments 622, particularly during curing, or hardening, of the transverse members 620 defining the helical structures 630. The use of these types of bound and hardened high strength fiber filament materials may provide for a desired level of strength and/or structural integrity of the truss structure 600. The materials, together with this type of construction may provide a desired level of strength/load bearing capability at a relatively lower weight, while also facilitating fabrication of the truss structure 600.

As noted above, the longitudinal member(s) 610 and the transverse member(s) 620 may be coupled, or joined, or bound together at the nodes 650 by a banding material 655, or a wrapping material 655. In some implementations, the banding material 655, or wrapping material 655, may be made of, for example, a carbon fiber material, a poly paraphenylene terephthalamide material, and the like. In some implementations, the tows 612, for example, carbon fiber tows 612, of the longitudinal members 610 and/or the tows 622, for example, carbon fiber tows 622, of the transverse members 620 may be pre-impregnated with, for example, a resin/epoxy material. In some implementations, the longitudinal members 610 and/or the transverse members 620 (defining the helical structures 630) may be fabricated in a substantially automated manner into rope like members. That is, in some implementations, the tows 612, 622 of filament material may be laid out and bound by the banding or wrapping material 615, 625, to provide for compaction of the filaments/tows 612, 622, and hardened, or cured. The arrangement of the pre-impregnated tows 612, 622 of filament material wrapped by the poly paraphenylene terephthalamide banding material 615, 625 (defining the longitudinal members 610 and transverse members 620 of the helical structures 630) may be cured to form the exemplary truss structure 600. The resulting rope like longitudinal members 610 and transverse members 620/helical structures 630 may facilitate the arrangement of the longitudinal members 610 and the transverse members 620/helical structures 630 in a desired configuration for a particular application.

For example, in the exemplary arrangement shown in FIG. 6A, a first helical structure 630A (including a transverse member 620A) may be positioned, for example, on a manufacturing frame. A second helical structure 630B (including transverse member(s) 620B) may then be positioned relative to the first helical structure 630A. After positioning the second helical structure 630B, the longitudinal members 610 may be positioned relative to the first and second helical structures 630A, 630B. The transverse member 620A (of the first helical structure 630A), the transverse member 620B (of the second helical structure 630B) and the longitudinal member 610 may be coupled, or joined, or bound together, at each of the nodes 650 by a banding material 655, or a wrapping material 655, made of, for example, a poly paraphenylene terephthalamide material. Thus, in the exemplary truss structure 600 shown in FIGS. 6A and 6B, the first and second helical structures 630A, 630B are positioned, essentially, at an inside of the longitudinal members 610, with the longitudinal members 610 extending along an outer peripheral portion of the assembled truss structure 600. In some implementations, the curing, and hardening, of the pre-impregnated tows 612, 622 of the longitudinal members 610 and the transverse members 620/helical structures 630 once positioned and bound together in this manner, may produce a truss structure that provides increased structural strength and/or integrity when compared to, for example, a similar sized structure made out of metal tubing/rods, and/or a truss structure having decreased weight when compared to, for example, a structure made out of metal tubing/rods intended to carry similar axial and torsional force.

Figure 7A:
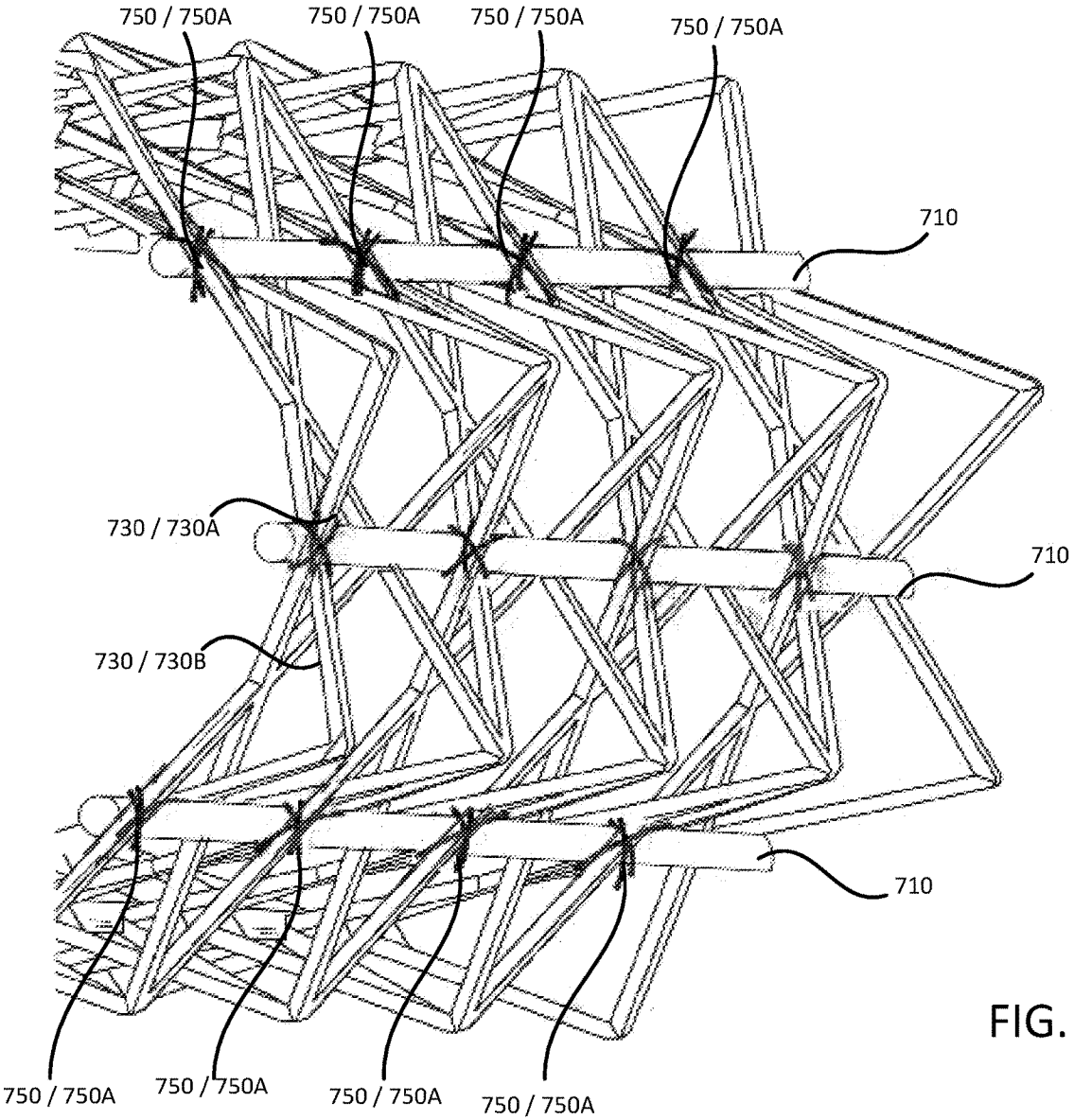
FIG. 7A is a partial perspective view of an exemplary truss structure, in accordance with implementations described herein.
Figure 7B:
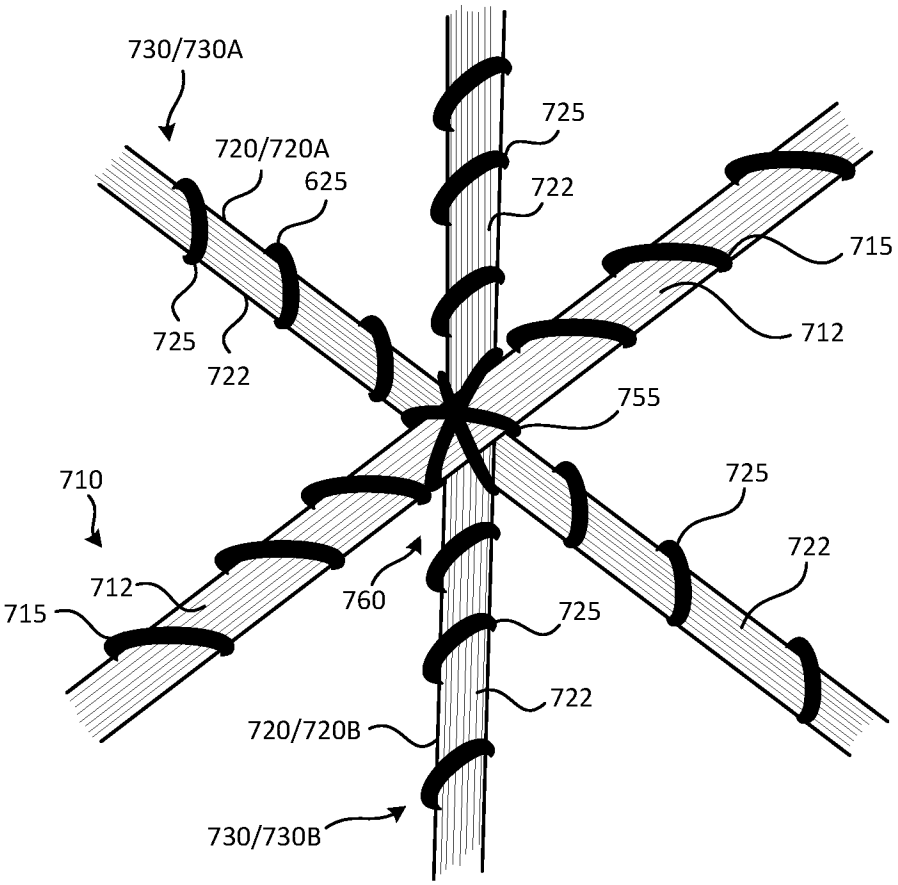
FIG. 7B is a close up view of an exemplary node of the exemplary truss structure shown in FIG. 7B, in accordance with implementations described herein.
Figure 8C:
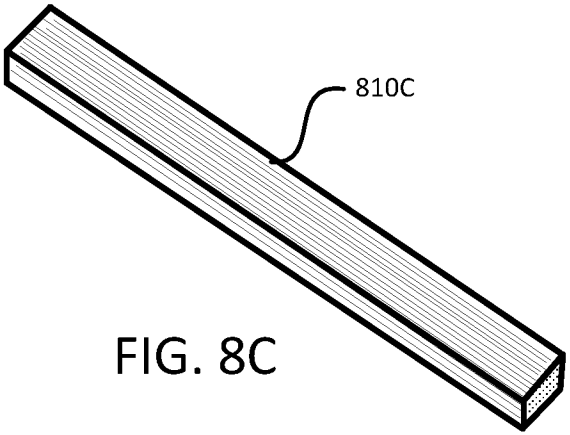
FIGS. 8A-8D illustrate exemplary longitudinal members of an exemplary truss structure, in accordance with implementations described herein.
Figure 8D:
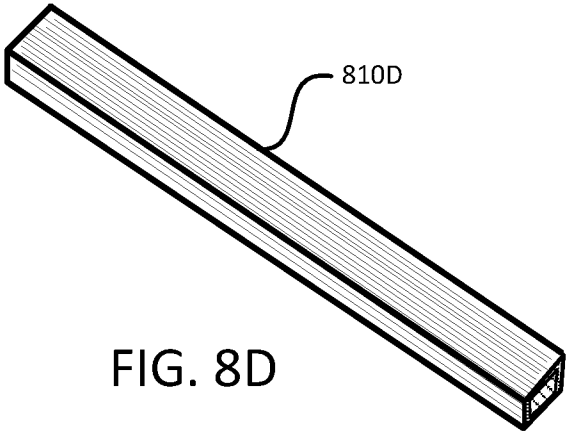
Figure 8A:
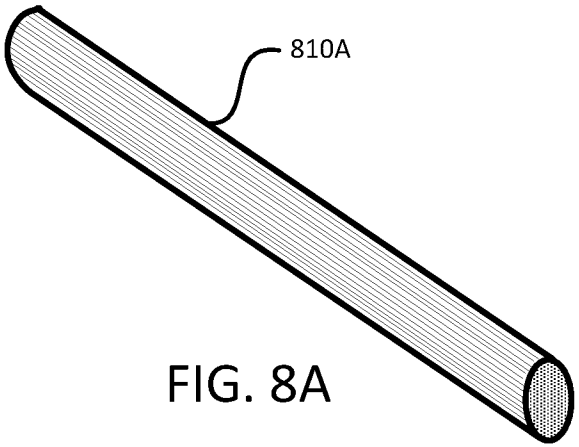
Figure 8B:
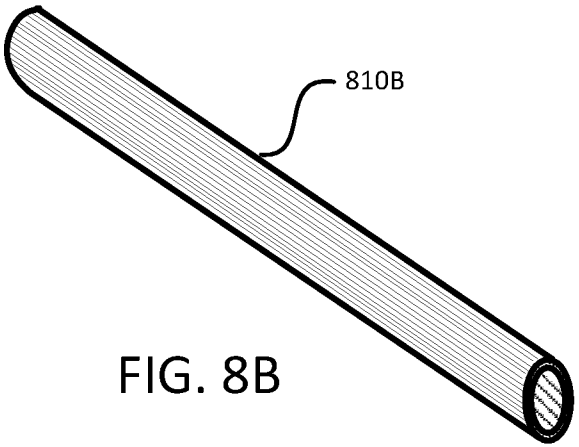

FIG. 7A is a partial perspective view of an exemplary truss structure 700, in accordance with implementations described herein, and FIG. 7B is a close up view of an exemplary node 750 of the exemplary truss structure 700 shown in FIG. 7A, in accordance with implementations described herein. As shown in FIGS. 7A and 7B, the exemplary truss structure 700 may include a plurality of longitudinal members 710 arranged in parallel to each other. The plurality of longitudinal members 710 may be arranged in parallel with the central longitudinal axis A of the truss structure 700, as described above. In some implementations, the longitudinal members 710 may be arranged symmetrically about any one of a plurality of different central planes extending through the central longitudinal axis A of the truss structure 700, such as, for example, the exemplary central plane B, as described above. A plurality of transverse 720 members may be arranged end to end, defining a plurality of helical structures 730. The plurality of helical structures 730 (defined by the plurality of transverse members 720) may be coupled to the plurality of longitudinal members 710 at a respective plurality of nodes 750. In some implementations, the nodes 750 may be defined at a location at which one or more helical structures 730 meet, or overlap with, a longitudinal member 710. In the example shown in FIGS. 7A and 7B, two helical structures 730 and one longitudinal member 710 meet, or overlap, at each node 750.

As described above, each of the longitudinal members 710 and/or each of the transverse members 720 may be made of a high strength fiber filament material 712, 722, for example, a carbon fiber material, a fiberglass material, and the like, arranged in tows, and wrapped, or bound, or lashed, or held together by a banding material 715, 725, or a wrapping material 715, 725, to provide for compaction of the tows of filament material 712, 722. In some implementations, the banding or wrapping material 715, 725 may be made of, for example, a carbon fiber material, a poly paraphenylene terephthalamide material, and the like. Such longitudinal members 710 and transverse members 720 (defining a plurality of helical structures 730) may provide a desired level of strength and/or structural integrity of the truss structure 700, while also facilitating fabrication of the truss structure 700.

The longitudinal member(s) 710 and the transverse member(s) 720 may be coupled, or joined, or bound together at the nodes 750 by the banding material 755, or a wrapping material 755, made of, for example, a carbon fiber material, a poly paraphenylene terephthalamide material, and the like. In some implementations, the tows 712 of the longitudinal members 710 and/or the tows 722 of the transverse members 720 may be pre-impregnated, for example, with a resin/epoxy material. In some implementations, the longitudinal members 710 and/or the transverse members 720 (defining the helical structures 730) may be fabricated in a substantially automated manner into rope like members, which may be positioned on a manufacturing fixture in the desired arrangement for a particular application. That is, in some implementations, the tows 712, 722 may be laid out and bound by the banding or wrapping material 715, 725, to provide for compaction of the filaments/tows 712, 722, and hardened, or cured. The arrangement of the pre-impregnated tows 712, 722 of filament material, wrapped by the poly paraphenylene terephthalamide banding material 715, 725 (defining the longitudinal members 710 and transverse members 720 of the helical structures 730) may be cured to form the exemplary truss structure 700. The resulting rope like longitudinal members 710 and transverse members 720 may facilitate the arrangement of the longitudinal members 710 and the transverse members 720 in a desired configuration for a particular application.

For example, in the exemplary arrangement shown FIG. 7B a first helical structure 730A (including transverse member(s) 720A) may be positioned, for example, on a manufacturing frame. After positioning the first helical structure 730A, the longitudinal members 710 may be positioned relative to the first helical structure 730A. A second helical structure 730B (including transverse member(s) 720B) may then be positioned relative to the first helical structure 730A and the longitudinal members 710. The transverse member 720A (of the first helical structure 730A), the longitudinal member 710, and the transverse member 720B (of the second helical structure 730B) may be coupled, or joined, or bound together, at the respective nodes 750 by a banding material 755, or a wrapping material 755, made of, for example, a poly paraphenylene terephthalamide material. Thus, in the exemplary truss structure 700 shown in FIGS. 7A and 7B, the longitudinal members 710 are positioned between the first and second helical structures 730A, 730B.

The truss structure 600 shown in FIGS. 6A and 6B illustrates a first exemplary arrangement at the node 650, including the first and second helical structures 630A, 630B positioned at an inner side of the longitudinal member 610 at the node 650. The truss structure 700 shown in FIGS. 7A and 7B illustrates a second exemplary arrangement at the node 750, including the longitudinal member 710 positioned between the first and second helical structures 730A, 730B at the node 750. Regardless of the arrangement of the transverse members (of the helical structures) relative to the longitudinal members of the truss structure, the curing, and hardening, of the pre-impregnated tows of the longitudinal members and the transverse members once positioned and bound together in this manner, may produce a truss structure that provides increased structural strength and/or integrity when compared to, for example, a similar sized structure made out of metal tubing/rods, and/or a truss structure having decreased weight when compared to, for example, a structure made out of metal tubing/rods intended to carry similar axial and torsional force.

In some implementations, a truss structure in accordance with implementations described herein may include wrapping or banding material coupling the helical structures to the longitudinal members at all of the nodes in the first exemplary arrangement, shown in FIGS. 6A and 6B. In some implementations, a truss structure in accordance with implementations described herein may include wrapping or banding material coupling the helical structures to the longitudinal members at all of the nodes in the second exemplary arrangement, shown in FIGS. 7A and 7B. In some implementations, a truss structure in accordance with implementations described herein may include wrapping or banding material coupling the helical structures to the longitudinal members at the nodes in which some of the couplings at the nodes are arranged in the first exemplary arrangement as shown in FIGS. 6A and 6B, and some of the couplings at the nodes are arranged in the second exemplary arrangement as shown in FIGS. 7A and 7B.

In some implementations, in a truss structure in accordance with implementations described herein, the longitudinal members and the helical structures may be joined at the nodes in other manners, regardless of the specific arrangements of the transverse members of the helical structures and the longitudinal members at the respective nodes. For example, in some implementations, curing or hardening of the pre-impregnated materials of transverse members/helical structures and the longitudinal members, after assembly of the elements of the truss structure as described above, may cause coupling, or adhesion, of the longitudinal members and the helical structures at the respective nodes. In some implementations, other adhesion agents, or coupling mechanisms, may be applied at the nodes to provide for the coupling of the transverse members/helical structures and the longitudinal members at the respective nodes. In some implementations, mechanical fasteners, such as, for example, clips, clamps and the like, may provide for the coupling of the transverse members/helical structures and the longitudinal members at the respective nodes. In some implementations, different combinations of coupling mechanisms may be applied at different nodes of a single truss structure to couple the helical structures and the longitudinal members forming the truss structure. In some implementations, similar types of coupling mechanisms may couple the helical structures, at points at which two helical structures overlap, outside of the nodes.

In some implementations, the plurality of helical structures may be formed, or manufactured, separately from the plurality of longitudinal members. In this situation, the plurality of previously manufactured helical structures, and previously manufactured longitudinal members, may then be assembled, and coupled, for example, at the nodes, in the manner described with respect to FIGS. 6A and 6B, and/or in the manner described with respect to FIGS. 7A and 7B, or other such manner. This may facilitate the use of different materials for the helical structures and/or for the longitudinal members, may allow for a configuration of the truss structure to be customized for a particular application, and the like.

As described above, in some implementations, the longitudinal members may include pre-impregnated filament material, arranged in tows, and bound by a binding or wrapping material to provide for compaction of the tows of pre-impregnated filament material, to maintain a desired cross sectional shape of the longitudinal members along the length thereof, and the like. In some implementations, the longitudinal members may be defined by pultruded rods, or bars, or hollow tubes. FIGS. 8A-8D illustrate exemplary pultruded longitudinal members 810, including a first exemplary pultruded longitudinal member 810A having a solid body and a substantially circular, or elliptical cross sectional shape, a second exemplary pultruded longitudinal member 810B having a hollow tubular body and a substantially circular, or elliptical cross sectional shape, a third exemplary pultruded longitudinal member 810C having a solid body and a substantially square, or rectangular cross sectional shape, and a fourth exemplary pultruded longitudinal member 810D having a hollow tubular body and a substantially square, or rectangular, cross sectional shape. The pultruded longitudinal members 810 may have other cross sectional shapes and/or configurations.

In producing these types of pultruded longitudinal members, spools of material, for example, carbon fiber filament material, may be fed into, or pulled through, a fabrication tool, and held in tension, or pulled, into a desired shape, or form, or contour. In some implementations, the filament material may be held in tension in a mold or mandrel, to facilitate achievement of the desired shape, or form, or contour, or cross section of the longitudinal member. In some implementations, the filament material may be impregnated with, for example, an epoxy/resin material. The filament material, for example, pre-impregnated carbon fiber filament material, may be held under tension, or pulled, and hardened, to produce the longitudinal members having a relatively uniform cross sectional shape and/or a relatively straight orientation along the length of the longitudinal member. In some implementations, the pultruded longitudinal member may be a solid rod having a relatively uniform cross sectional shape and/or a relatively straight orientation along the length thereof. In some implementations, the pultruded longitudinal member may be a tube, for example, a hollow tube, having a relatively uniform cross sectional shape and/or a relatively straight orientation along the length thereof. These types of pultruded longitudinal members may allow for separate fabrication of longitudinal members having relatively uniform cross sectional shape along the length of the longitudinal member, a relatively straight orientation along the length of the longitudinal member, a relatively smooth surface contour along the length of the longitudinal member, and other such characteristics which may further enhance the strength and load bearing characteristics of the longitudinal members.

In the foregoing disclosure, it will be understood that when an element, such as a layer, a region, or a substrate, is referred to as being on, connected to, or coupled to another element, it may be directly on, connected or coupled to the other element, or one or more intervening elements may be present. In contrast, when an element is referred to as being directly on, directly connected to or directly coupled to another element or layer, there are no intervening elements or layers present. Although the terms directly on, directly connected to, or directly coupled to may not be used throughout the detailed description, elements that are shown as being directly on, directly connected or directly coupled can be referred to as such. The claims of the application may be amended to recite exemplary relationships described in the specification or shown in the figures.

As used in this specification, a singular form may, unless definitely indicating a particular case in terms of the context, include a plural form. Spatially relative terms (e.g., over, above, upper, under, beneath, below, lower, and so forth) are intended to encompass different orientations of the device in use or operation in addition to the orientation depicted in the figures. In some implementations, the relative terms above and below can, respectively, include vertically above and vertically below. In some implementations, the term adjacent can include laterally adjacent to or horizontally adjacent to.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A three-dimensional (3D) load bearing structure, comprising:

a plurality of helical structures concentrically arranged about a central longitudinal axis, wherein each of the plurality of helical structures includes:

a plurality of strands of pre-impregnated carbon fiber filament material; and a poly paraphenylene terephthalamide binding material on an outer peripheral portion of the strands of filament material, holding the plurality of strands of filament material together; and a plurality of longitudinal members each aligned in parallel with the central longitudinal axis, each of the plurality of longitudinal members including a pultruded rod or tube made of a carbon fiber material; and a coupling mechanism including a poly paraphenylene terephthalamide binding material, coupling the plurality of helical structures to the plurality of longitudinal members at a respective plurality of nodes, wherein each node of the plurality of nodes is defined at a point at which a longitudinal member, of the plurality of longitudinal members, and at least one helical structure, of the plurality of helical structures, overlap.

2. The structure of claim 1, wherein each of the plurality of helical structures includes:

the plurality of strands of pre-impregnated carbon fiber filament material arranged in tows; and the poly paraphenylene terephthalamide binding material on an outer peripheral portion of the tows of carbon fiber filament material, holding the plurality of tows together in a set cross sectional shape along a length of the respective helical structure.

3. The structure of claim 2, wherein the binding material extends in a helical pattern along the outer peripheral portion of the tows of carbon fiber filament material.

4. The structure of claim 2, wherein each of the plurality of longitudinal members includes:

the pultruded rod or tube including a plurality of strands of pre-impregnated carbon fiber filament material arranged in tows; and the poly paraphenylene terephthalamide binding material on an outer peripheral portion of the tows of carbon fiber filament material, holding the plurality of tows together in a set cross sectional shape along a length of the longitudinal member.

5. The structure of claim 4, wherein the plurality of helical structures and the plurality of longitudinal members are cured and hardened after coupling of the plurality of helical structures and the plurality of longitudinal members at the plurality of nodes.

6. The structure of claim 1, wherein the at least one helical structure includes a first helical structure and a second helical structure of the plurality of helical structures, and wherein the coupling mechanism includes, at each node of the plurality of nodes, the poly paraphenylene terephthalamide binding material binding the respective longitudinal member with the first helical structure and the second helical structure, with the longitudinal member positioned between the first helical structure and the second helical structure.

7. The structure of claim 1, wherein the at least one helical structure includes a first helical structure and a second helical structure of the plurality of helical structures, and wherein the coupling mechanism includes, at each node of the plurality of nodes, the poly paraphenylene terephthalamide binding material binding the respective longitudinal member with the first helical structure and the second helical structure, with the longitudinal member positioned at an outer peripheral portion of the first and second helical structures.

8. The structure of claim 1, wherein the plurality of longitudinal members are arranged symmetrically with respect to a central plane extending through the central longitudinal axis.

9. A method, comprising:

sequentially arranging a plurality of helical structures concentrically about a central longitudinal axis, each of the plurality of helical structures including a plurality of pre-impregnated carbon fiber filaments bound by a poly paraphenylene terephthalamide binding material;

arranging a plurality of longitudinal members about the central longitudinal axis such that each of the plurality of longitudinal members is aligned in parallel with the central longitudinal axis, each of the plurality of longitudinal members including a pultruded rod or tube made of carbon fiber material; and coupling the plurality of helical structures to the plurality longitudinal members at a respective plurality of nodes, each node of the plurality of nodes being defined at a point at which a longitudinal member, of the plurality of longitudinal members, and at least one helical structure, of the plurality of helical structures, cross, including:

at each node, of the plurality of nodes, binding, with a poly paraphenylene terephthalamide binding material, the longitudinal member with a previously cured and hardened first helical structure and a previously cured second helical structure, of the plurality of helical structures.

10. The method of claim 9, further comprising:

curing the coupled plurality of helical structures and the plurality of longitudinal members to form a load bearing structure, including heating the coupled plurality of helical structures and the plurality of longitudinal members so as to harden the plurality of helical structures and the plurality of longitudinal members.

11. The method of claim 9, wherein arranging the plurality of longitudinal members about the central longitudinal axis includes arranging the plurality of longitudinal members symmetrically with respect to a central plane extending through the central longitudinal axis.

12. The method of claim 9, wherein coupling the plurality of helical structures to the plurality of longitudinal members at the respective plurality of nodes includes:

at each node, of the plurality of nodes, binding the longitudinal member with a first helical structure and a second helical structure, of the plurality of helical structures, with the poly paraphenylene terephthalamide binding material, with the longitudinal member positioned between the first helical structure and the second helical structure.

13. The method of claim 9, wherein coupling the plurality of helical structures to the plurality longitudinal members at the respective plurality of nodes includes:

at each node, of the plurality of nodes, binding the longitudinal member with a first helical structure and a second helical structure, of the plurality of helical structures, with the poly paraphenylene terephthalamide binding material, with the first helical structure and the second helical structure positioned between the central longitudinal axis and the longitudinal member, such that the longitudinal member is positioned along an outer peripheral portion of a load bearing structure formed by the coupled plurality of helical structures and plurality of longitudinal members.

* * * * *